US005507599A

United States Patent [19]

Anderson et al.

[11] Patent Number: 5,507,599

[45] **Date of Patent: * Apr. 16, 1996**

[54] MODULAR BLOCK RETAINING WALL CONSTRUCTION AND COMPONENTS

[75] Inventors: Peter L. Anderson, Centreville; Michael J. Cowell, Leesburg; Dan J. Hotek, Chantilly, all of Va.

[73] Assignee: Societe Civile des Brevets Henri C. Vidal, France

[ * ] Notice: The portion of the term of this patent subsequent to Jan. 30, 2013, has been disclaimed.

[21] Appl. No.: 40,904

[22] Filed: Mar. 31, 1993

[51] Int. Cl.[6] ..... E02D 29/02

[52] U.S. Cl. ..... 405/286; 405/262

[58] Field of Search ..... 405/262, 284, 405/285, 286, 287, 287.1

[56] References Cited

U.S. PATENT DOCUMENTS

| | | | |
|---|---|---|---|
| 126,547 | 5/1872 | Hickcox . | |
| 228,052 | 5/1880 | Frost . | |
| D. 237,704 | 11/1975 | Lane | D18/2 |
| 295,788 | 5/1988 | Forsberg | D25/113 |
| 295,790 | 5/1988 | Forsberg | D25/116 |
| 296,007 | 5/1988 | Forsberg | D25/116 |
| 296,365 | 6/1988 | Forsberg | D25/116 |
| 297,464 | 8/1988 | Forsberg | D25/114 |
| 297,574 | 9/1988 | Forsberg | D25/114 |
| 297,767 | 9/1988 | Forsberg | D25/58 |
| 298,463 | 11/1988 | Forsberg | D25/114 |

(List continued on next page.)

FOREIGN PATENT DOCUMENTS

| | | |
|---|---|---|
| 2031077 | 5/1991 | Canada . |
| 0079880 | 5/1983 | European Pat. Off. . |
| 0047717 | 6/1983 | European Pat. Off. . |
| 0047718 | 5/1984 | European Pat. Off. . |
| 0170113 | 2/1986 | European Pat. Off. . |
| 0212357 | 3/1987 | European Pat. Off. . |
| 0379466 | 1/1990 | European Pat. Off. . |
| 0430890A1 | 6/1991 | European Pat. Off. . |
| 0472993 | 3/1992 | European Pat. Off. . |
| 392474 | 11/1908 | France . |
| 1360872 | 4/1963 | France . |
| 2216823 | 8/1974 | France . |
| 7528079 | 9/1975 | France . |
| 2367147 | 5/1978 | France . |

(List continued on next page.)

OTHER PUBLICATIONS

AASHTO–AGC–ARTBA Joint Committee, Subcommittee On New Highway Materials, Task force 27 Report "In Situ Soil Improvement Techniques" (Undated).

Silifrance Product Information Sheet (Undated).

Besser Co. "The Beauty of Concrete Block" (Undated).

Rockwood Classic Retaining Wall System Product Information Sheet (Undated).

Earthworks™ Retaining Wall System Products Information Sheet (Undated).

EarthStone™ Erosion Control/Retaining Wall System Product Information Sheet (Undated).

Rockwood Retaining Walls, Inc. Product Information Sheet (Undated).

RISI Stone Retaining Wall Systems "Preserving Our Environment" Information Brochure (1976).

Reinforced Earth Co.® "Design of Live Storage Structures Using Reinforced Earth®" (1983).

Reinforced Earth Co.® "Industrial Applications of Reinforced Earth® Structures" (1988).

(List continued on next page.)

*Primary Examiner*—David H. Corbin

*Attorney, Agent, or Firm*—Banner & Allegretti, Ltd.

[57] ABSTRACT

A modular block wall includes dry cast, unreinforced modular wall blocks with anchor type, or frictional type or composite type soil stabilizing elements recessed therein and attached thereto by vertical rods which also connect the blocks together. The soil stabilizing elements project into the compacted soil behind the courses of modular wall blocks from counterbores or slots in the blocks.

46 Claims, 15 Drawing Sheets

U.S. PATENT DOCUMENTS

| | | | |
|---|---|---|---|
| 299,067 | 12/1988 | Forsberg | D25/58 |
| 300,253 | 3/1989 | Forsberg | D25/114 |
| 300,254 | 3/1989 | Forsberg | D25/114 |
| 301,064 | 5/1989 | Forsberg | D25/116 |
| 311,444 | 10/1990 | Forsberg | D25/113 |
| 317,048 | 5/1991 | Forsberg | D25/114 |
| 566,924 | 9/1896 | Morrin . | |
| 810,748 | 1/1906 | Haller et al. . | |
| 1,092,621 | 4/1914 | Worner . | |
| 1,414,444 | 5/1922 | Straight . | |
| 1,456,498 | 5/1923 | Binns . | |
| 1,762,343 | 6/1930 | Munster . | |
| 1,818,416 | 8/1931 | Meara . | |
| 2,235,646 | 3/1941 | Schaffer | 72/101 |
| 2,252,155 | 8/1941 | Baldwin | 72/103 |
| 2,313,363 | 3/1943 | Schmitt . | |
| 2,882,689 | 4/1959 | Huch et al. | 61/35 |
| 2,963,828 | 12/1960 | Belliveau | 50/425 |
| 3,036,407 | 5/1962 | Dixon | 50/443 |
| 3,252,287 | 5/1966 | Suzuki | 61/5 |
| 3,274,742 | 9/1966 | Paul, Jr. et al. | 52/245 |
| 3,332,187 | 7/1967 | Arcari | 52/309 |
| 3,390,502 | 7/1968 | Carroll | 52/424 |
| 3,430,404 | 3/1969 | Muse | 52/439 |
| 3,557,505 | 1/1971 | Kaul | 52/275 |
| 3,686,873 | 8/1972 | Vidal | 61/39 |
| 3,936,987 | 2/1976 | Calvin | 52/309 |
| 3,995,434 | 12/1976 | Kato et al. | 61/4 |
| 3,998,022 | 12/1976 | Muse | 52/574 |
| 4,016,693 | 4/1977 | Warren | 52/405 |
| 4,110,949 | 9/1978 | Cambiuzzi et al. | 52/437 |
| 4,116,010 | 9/1978 | Vidal | 405/262 |
| 4,207,718 | 6/1980 | Schaaf et al. | 52/585 |
| 4,208,850 | 6/1980 | Collier | 52/285 |
| 4,228,628 | 10/1980 | Schlomann | 52/438 |
| 4,229,123 | 10/1980 | Heinzmann | 405/273 |
| 4,312,606 | 1/1982 | Sarikelle | 405/286 |
| 4,324,508 | 4/1982 | Hilfiker et al. | 405/284 |
| 4,329,089 | 5/1982 | Hilfiker et al. | 405/262 |
| 4,335,549 | 6/1982 | Dean, Jr. | 52/98 |
| 4,449,857 | 5/1984 | Davis | 405/286 |
| 4,454,699 | 6/1984 | Strobl | 52/585 |
| 4,470,728 | 9/1984 | Broadbent | 405/284 |
| 4,496,266 | 1/1985 | Ruckstuhl | 404/41 |
| 4,505,621 | 3/1985 | Hilfiker et al. | 405/284 |
| 4,524,551 | 6/1985 | Scheiwiller | 52/98 |
| 4,572,699 | 2/1986 | Rinninger | 404/42 |
| 4,725,170 | 2/1988 | Davis | 405/286 |
| 4,802,320 | 2/1989 | Forsberg | 52/585 |
| 4,825,619 | 5/1989 | Forsberg | 52/562 |
| 4,909,010 | 3/1990 | Gravier | 52/609 |
| 4,914,876 | 4/1990 | Forsberg | 52/169.4 |
| 4,961,673 | 10/1990 | Pagano et al. | 405/287 |
| 4,998,397 | 3/1991 | Orton | 52/715 |
| 5,004,376 | 4/1991 | Vidal et al. | 405/284 |
| 5,091,247 | 2/1992 | Willibey et al. | 428/255 |

FOREIGN PATENT DOCUMENTS

| | | |
|---|---|---|
| 2610962 | 8/1988 | France . |
| 2633650 | 1/1990 | France . |
| 2414202 | 10/1975 | Germany . |
| 2944550 | 9/1981 | Germany . |
| 3025883 | 1/1982 | Germany . |
| 3401629A1 | 7/1984 | Germany . |
| 4103330 | 9/1991 | Germany . |
| 586016 | 9/1981 | Japan . |
| 84735 | 6/1920 | Sweden . |
| 205452 | 9/1939 | Sweden . |
| 27174 | of 1930 | U.S.S.R. . |
| 894038 | 12/1981 | U.S.S.R. . |
| 1090803A | 5/1984 | U.S.S.R. . |
| 336 | of 1871 | United Kingdom . |
| 14528 | of 1913 | United Kingdom . |
| 1385207 | 2/1975 | United Kingdom . |
| 2014222 | 11/1979 | United Kingdom . |
| 2127872 | 4/1984 | United Kingdom . |
| 383156103 | 11/1992 | United Kingdom . |
| 8802050 | 3/1988 | WIPO . |

OTHER PUBLICATIONS

Versa–Lok® Retaining Wall Systems Information Brochure (1989).

Structural Block Systems, Inc. "Introducing Radial Block" (1990).

Allan Block™ Retaining Walls "A Mortarless, Stackable Concrete Block Retaining Wall System" (1990).

Interim, Highway Bridges, Division 1—Design, 5.8.7.2 "Polymeric Reinforcements" (1991).

Westblock Products, Inc. "GravityStone™" (1992).

Genesis™ Highway Wall System (1992).

Hunziker "Cobra" (1992).

Keystone™ Retaining Wall Systems "Standard Unit" (1993).

Keystone™ Retaining Wall Systems "Mini and Cap Unit" (1993).

Publication "Modular Concrete Block" (1984).

Publication "Paving Stone: A New Look with Old World Charm" (1984).

Publication "Methods of Making Split Corners" (1985).

Hollow Building Assoc. Handbook "Standard Load–Bearing Wall Tile" (1924).

Concrete Masonry Pictorial, vol. 33 No. 3, c.1977 p. 5.

The Contractor, vol. 2 No. 9, Oct. 1987, pp. 13–16.

Tensar Concrete GeoWall Brochure (1986).

80
182
94
185
80
103
80
80
100

40
40
50

72
40
75
40
70
70
72

80
82
80
85
80
80

94
100
80
82
85
94
80
100

94
80
100
80

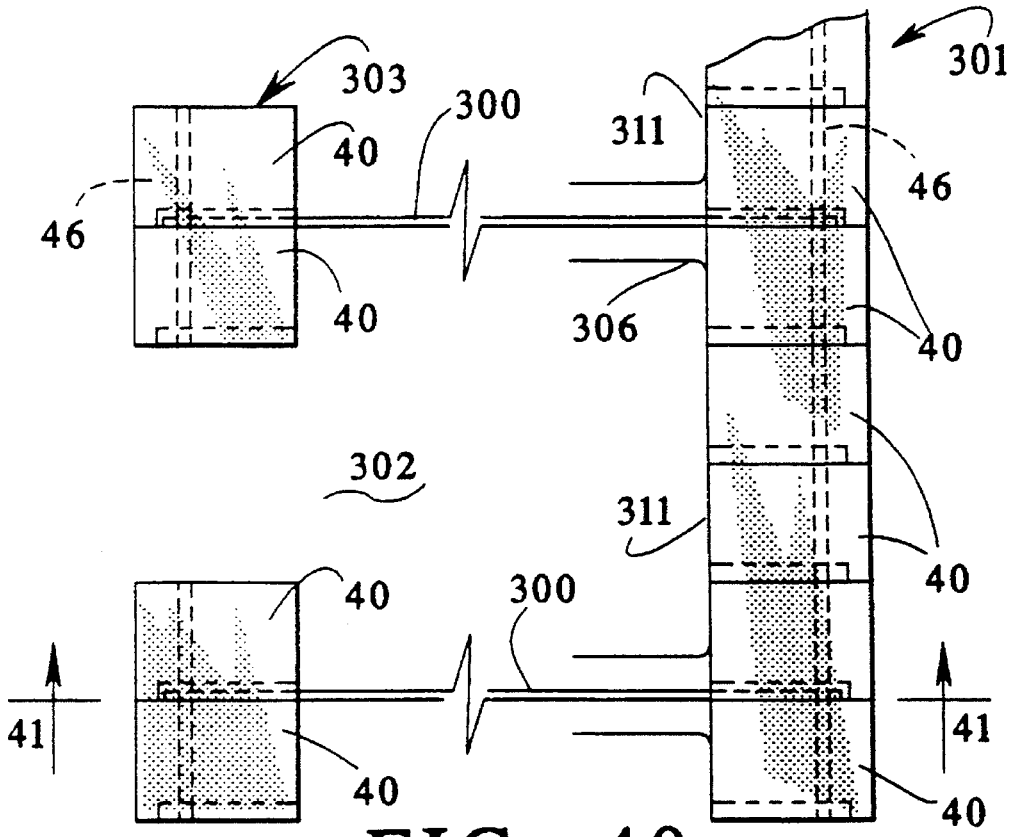
FIG. 40
FIG. 13A
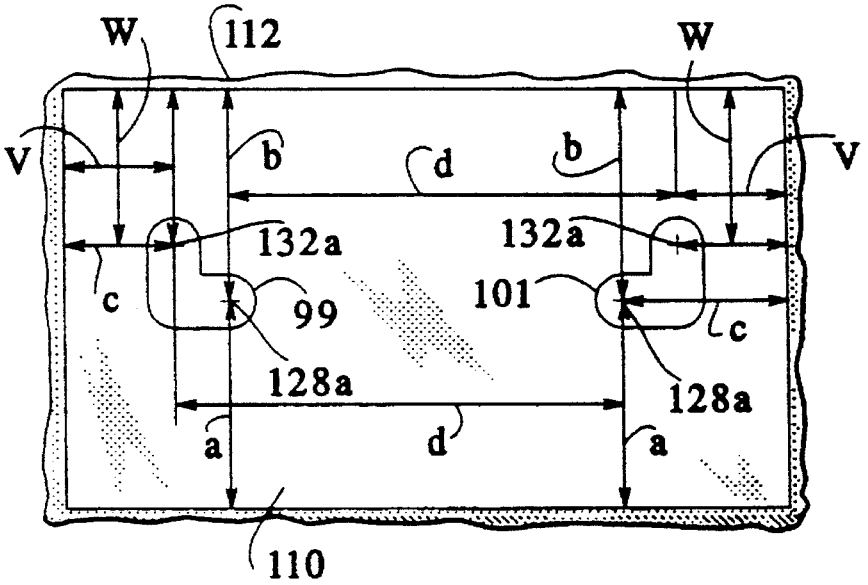

MODULAR BLOCK RETAINING WALL CONSTRUCTION AND COMPONENTS

BACKGROUND OF THE INVENTION

This invention relates to an improved retaining wall construction and, more particularly, to a retaining wall construction comprised of modular blocks, in combination with tie-back and/or mechanically stabilized earth elements and compacted particulate or soil.

In U.S. Pat. No. 3,686,873 and No. 3,421,326, Henri Vidal discloses a new constructional work now known as a mechanically stabilized earth structure. The referenced patents also disclose methods for construction of retaining walls, embankment walls, platforms, foundations, etc. In a typical Vidal construction, particulate earthen material interacts with elements such as elongated steel strips positioned at appropriately spaced intervals in the earthen material. The elements are attached to reinforced precast concrete panels and, the combination forms a cohesive support wall. The elements extending into the earthen works interact with soil particles principally by frictional interaction and thus act to mechanically stabilize the earthen work. The elements may also perform a tie-back or anchor function.

Various embodiments of the Vidal development have been commercially available under various trademarks including the trademarks, REINFORCED EARTH embankments and RETAINED EARTH embankments. Moreover, alternative constructional works of this general nature have been developed. By way of example and not by way of limitation, Hilfiker in U.S. Pat. No. 4,324,508 discloses a retaining wall comprised of elongated panel members with wire grid mats attached to the backside of the panel members projecting into an earthen mass. Vidal and Hilfiker disclose large precast, reinforced concrete panel members cooperative with strips, mats, etc. Vidal and Hilfiker disclose various shapes of panel members. In Vidal and Hilfiker the elements that are interactive with the earth or particulate behind the panels or blocks, are typically rigid steel strips or mats and rely upon friction and/or anchoring techniques, although ultimately all interaction between such elements and the earth or particulate is dependent upon friction.

It is sometimes difficult or not practical to work with large panel members like those disclosed in Vidal or Hilfiker inasmuch as mechanical lifting equipment is often required to position such panels. Forsberg in U.S. Pat. No. 4,914,876 discloses the use of smaller retaining wall blocks in combination with flexible plastic netting to provide a mechanically stabilized earth retaining wall structure. Using flexible plastic netting and smaller, specially constructed blocks arranged in rows superimposed one upon the other, reduces the necessity for large mechanical lifting equipment.

Others have also suggested the utilization of facing blocks of various configuration with concrete anchoring and/or frictional netting material. Among the various products commercially available is a product offered by Rockwood Retaining Walls, Inc. of Rochester, Minn. and a product offered by Westblock Products, Inc. and sold under the tradename, Gravity Stone. Common features of these systems appear to be the utilization of various facing elements in combination with backfill, wherein the backfill is interactive with plastic or fabric reinforcing and/or anchoring means which are attached to the facing elements. Thus, there is a great diversity of such combinations available in the marketplace or disclosed in various patents and other references.

Nonetheless, there has remained the need to provide an improved system utilizing anchoring and/or frictional interaction of backfill and elements positioned in the backfill wherein the elements are cooperative with and attachable to facing elements, particularly blocks which are smaller and lighter than large facing panels such as utilized in many installations. The present invention comprises an improved combination of elements of this general nature and provides enhanced versatility in the erection of retaining walls and embankments, as well as in the maintenance and cost of such structures.

SUMMARY OF THE INVENTION

Briefly, the present invention comprises a combination of components to provide an improved retaining wall system or construction as well as the components or elements from which the improved retaining wall is fabricated. An important feature of the invention is the modular wall block which is used as a facing component for the retaining wall construction. The modular wall block may be unreinforced and dry cast. The bloek includes a front face which is generally planar, but may be configured in almost any desired finish and shape. The wall block also includes generally converging side walls, generally parallel top and bottom surfaces, a back wall, vertical throughbores or passages through the block specially positioned to enhance the modular character of the block and counterbores for the throughbores of a particular shape and configuration which permit the block to be integrated with and cooperative with various types of anchoring and/or earth stabilizing elements. Special corner block constructions are also disclosed.

Various earth stabilizing and/or anchor elements are also disclosed for cooperation with the modular wall or face block. A preferred embodiment of the earth stabilizing and/or anchoring elements include first and second generally parallel tensile rods which are designed to longitudinally extend from the modular wall block into soil or an earthen work. The ends of the tensile rods are configured to fit within block counterbores defined in the top or bottom surface of the modular wall or facing block. Cross members connect the parallel tensile rods and are arrayed not only to enhance the anchoring characteristics, but also the frictional characteristics of interaction of the tensile rods with earth or particulate material comprising the wall. The described wall construction further includes generally vertical anchoring ,rods that interact both with the stabilizing elements and also with the described modular blocks by extending vertically through the throughbores in those blocks and simultaneously engaging the stabilizing elements.

An alternative stabilizing element cooperative with the modular blocks comprises a harness which includes general parallel tension arms interactive with the counterbores in the blocks and also with the vertical anchoring rod for attaching the tension arms to the block. The harness includes a cross member connecting the opposite arms outside of the modular block adjacent the back face. The cross member of the harness may be cooperative with a geotextile strip, for example, which projects into the earthen work behind the modular wall block. Again, the harness is interactive with vertical anchoring rods which cooperate with the passages or throughbores defined in the modular blocks. Various other alternative permutations, combinations and constructions of the described components are set forth.

Thus it is an object of the invention to provide an improved retaining wall construction comprised of modular blocks and stabilizing elements cooperative therewith that project into an earthen work or particulate material.

It is a further object of the invention to provide an improved and unique modular block construction for utilization in the construction of a improved retaining wall construction.

Yet another object of the invention is to provide a modular block construction which may be easily fabricated utilizing known casting or molding techniques.

Yet a further object of the invention is to provide a substantially universal modular block which is useful in combination with earth retaining or stabilizing elements as well as anchoring elements.

Yet another object of the invention is to provide unique earth anchoring and/or stabilizing elements that are cooperative with a modular facing block.

Yet a further object of the invention is to provide a combination of components for manufacture of a retaining wall system or construction which is inexpensive, efficient, easy to use and which may be used in designs associated with conventional design criteria.

Another object of the invention is to provide a design for a modular block which may be used in a mechanically stabilized earth construction or an anchor wall construction wherein the block may be unreinforced and/or manufactured by dry cast or pre-cast methods, and/or interactive with rigid, metal stabilizing elements as well as flexible stabilizing elements such as geotextiles.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 13A is a top plan view of an alternate throughbore pattern for a corner block;

FIG. 40 is a side elevation of an alternative wall construction utilizing anchor type stabilizing elements.

DESCRIPTION OF THE PREFERRED EMBODIMENTS

General Description

Figure 1:
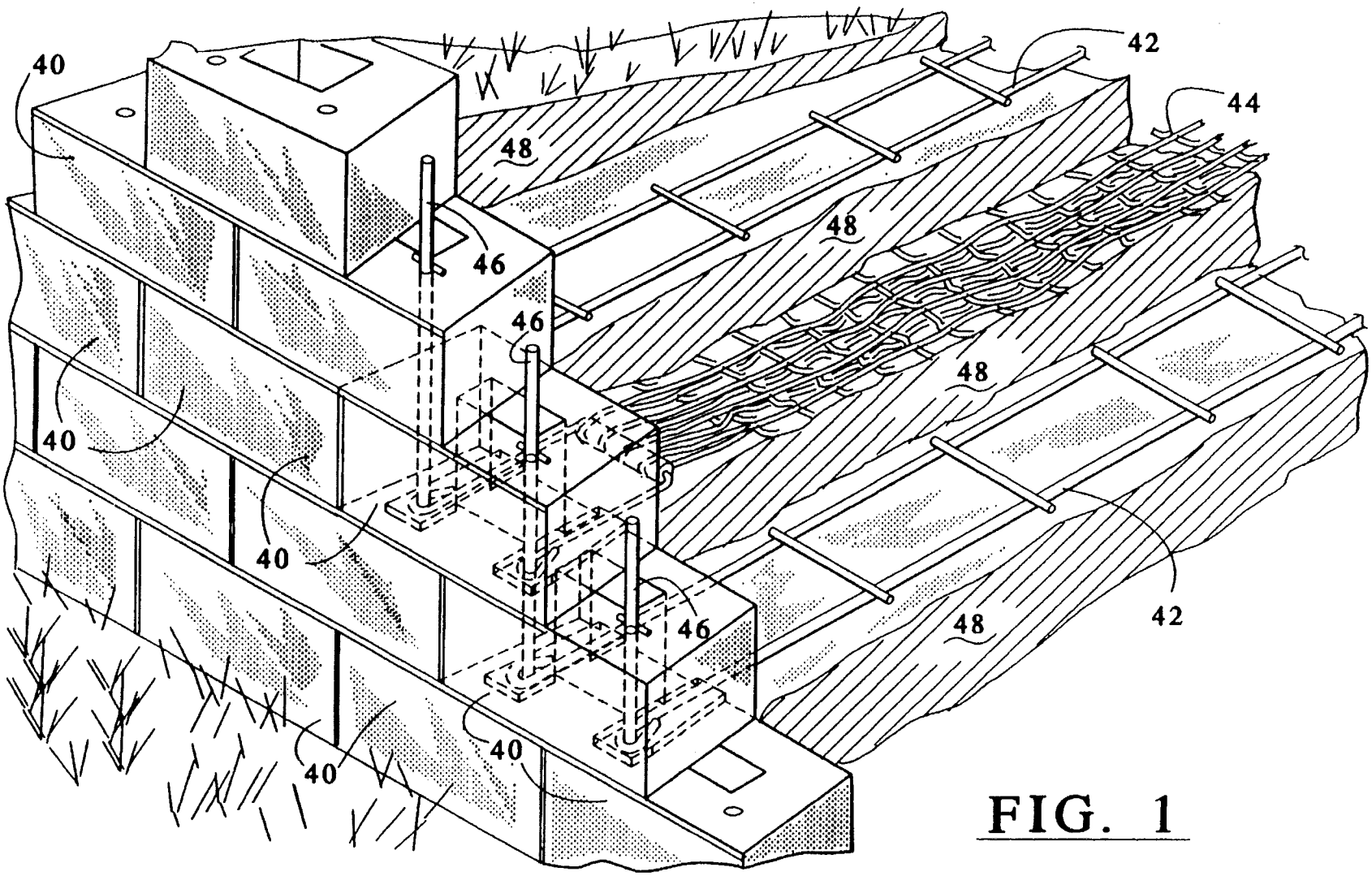
FIG. 1 is an isometric, cut away view of an embodiment and example of the modular block retaining wall construction of the invention incorporating various alternative elements/or components.
Figure 3:
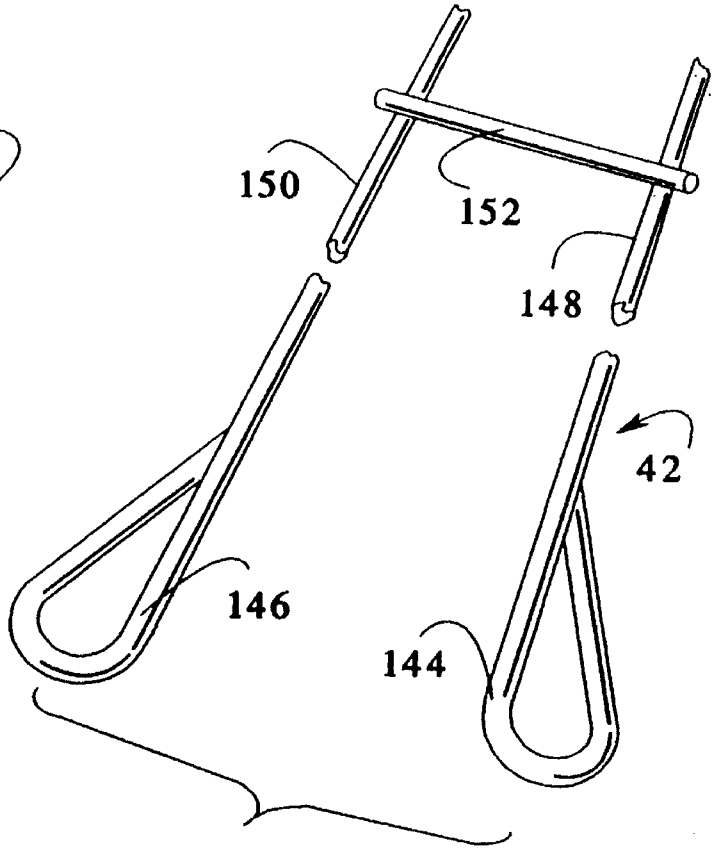
FIG. 3 is an isometric view of an earthen stabilizing and/or anchor element which is used in combination with the modular block of FIG. 2 and which cooperates with and interacts with earth or participate by means of friction and/or anchoring means or both.

FIG. 1 generally depicts the combination of components or elements which define the modular block retaining wall construction of the invention. Modular blocks 40 are arranged in courses one upon the other in an overlapping array. Generally rigid earth retaining or stabilizing elements 42 and/or flexible stabilizing elements 44 are cooperative with or interact with the blocks 40. Also anchoring elements may be utilized in cooperation with blocks 40. Stabilizing or anchoring elements are attached to blocks 40 by means of vertical anchoring rods 46. The elements 42 and/or 44 project from the back face of blocks 40 into compacted soil 48 and interact with the soil 48 as anchors and/or frictionally.

It is noted that interaction between the elements 42 and 44 and soil or particulate 48 depends ultimately upon frictional interaction of particulate material comprising the soil 48 with itself and with elements, such as elements 42 and 44. Conventionally, that interaction may be viewed as an anchoring interaction in many instances rather than a frictional interaction. Thus, for purposes of the disclosure of the present invention, both types of interaction of compacted soil 48 with stabilizing and/or anchor elements are considered to be generally within the scope of the invention.

The invention comprises a combination of the described components including the blocks 40, stabilizing elements 42 and/or 44, anchoring rods 46 and soil 48 as well as the separate described components themselves, the method of assembly thereof, the method of manufacture of the separate components and various ancillary or alternative elements and their combination.. Following is a description of these various components, combinations and methods.

Facing Block Construction

Figure 2:
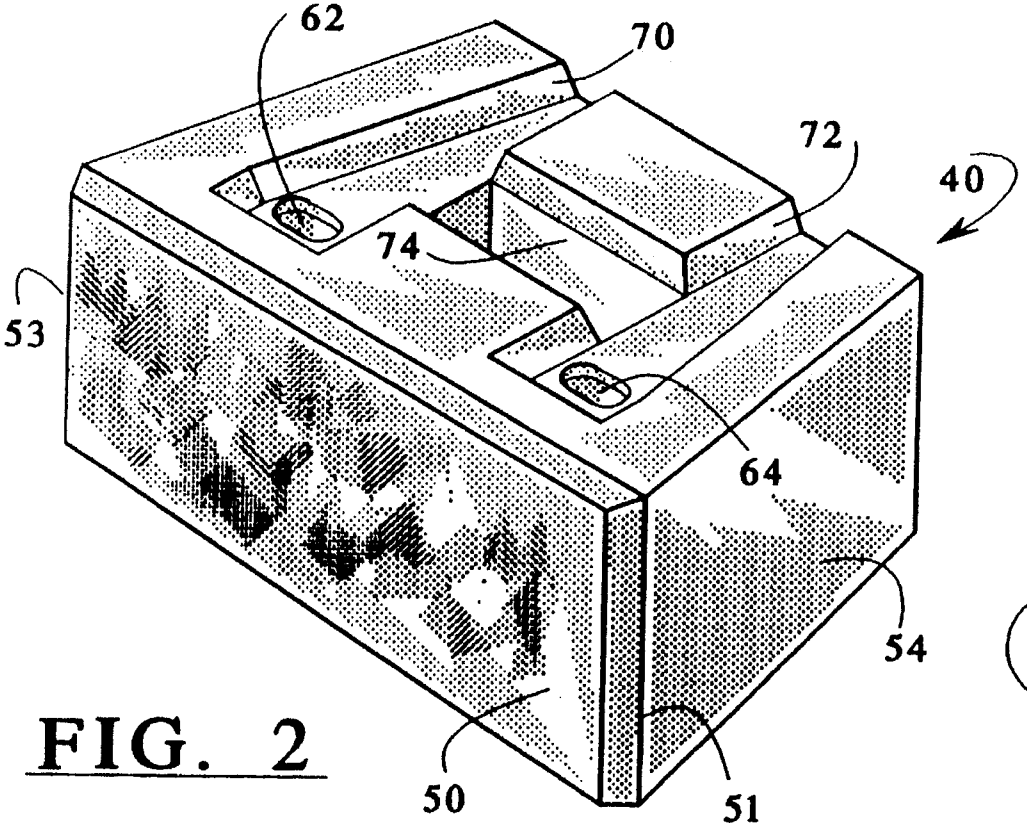
FIG. 2 is an isometric view of the improved standard modular wall block utilized in the retaining wall construction of the invention.
Figure 7:
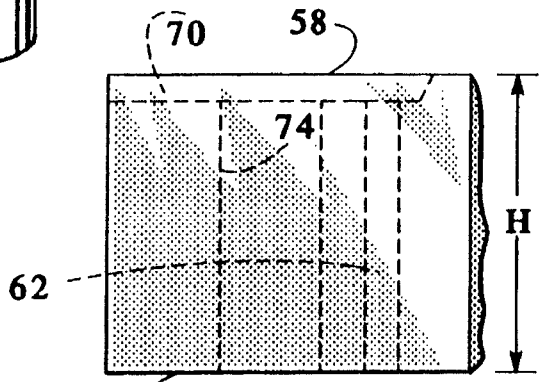
FIG. 7 is a side elevation of the block of FIG. 5.
Figure 5:
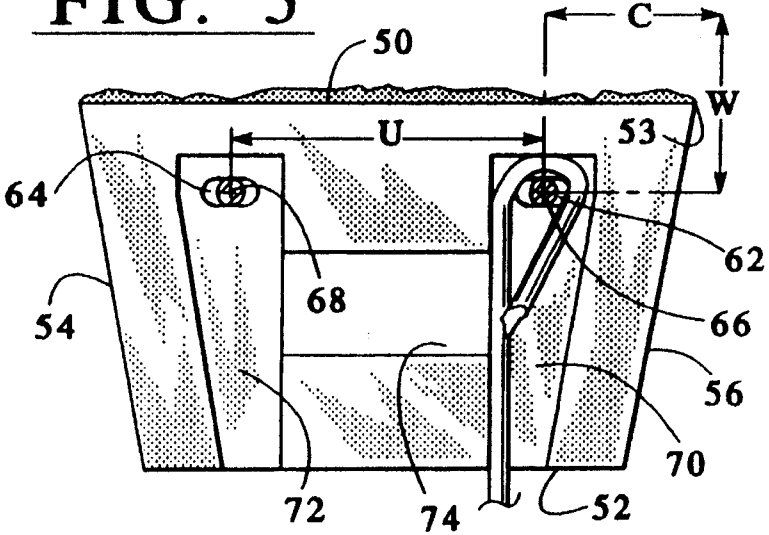
FIG. 5 is a top plan view of the block of FIG. 2.
Figure 6:
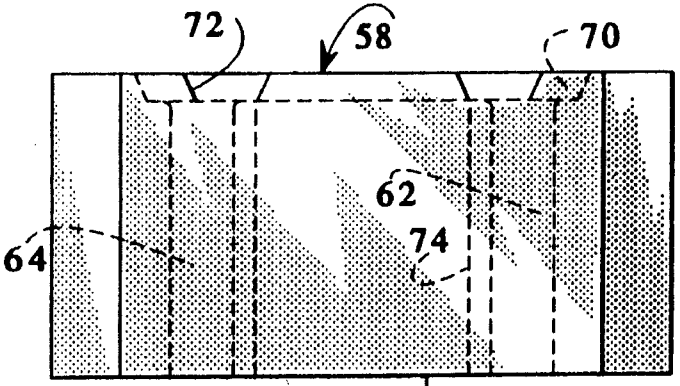
FIG. 6 is a rear elevation of the block of FIG. 5.
Figures 30, 31, 32, 33, 34, 34A:
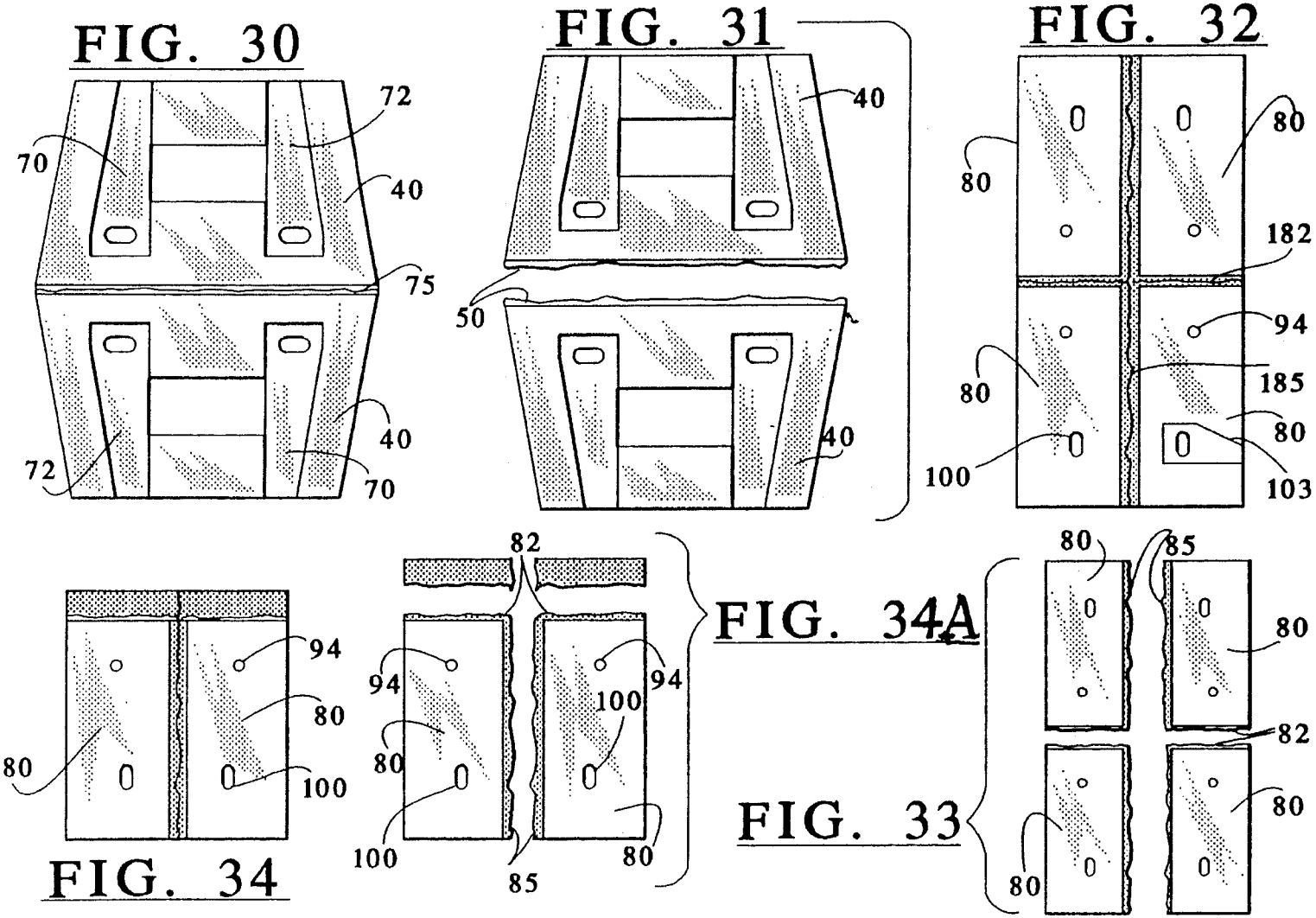
FIG. 30 is a top plan view of the modular facing block of the invention as it is initially dry cast in a mold for a pair of facing blocks.
FIG. 31 is a top plan view similar to FIG. 30 depicting the manner in which the cast blocks of FIG. 30 are separated to provide a pair of separate modular facing blocks.
FIG. 32 is a top plan view of the cast formation of the corner blocks.
FIG. 33 is a top plan view of the corner blocks of FIG. 32 after they have been split or separated.
FIG. 34 is a plan view of an alternative casting array for corner blocks.
FIG. 34A is a plan view of the array of FIG. 34 after separation of the blocks.

FIG. 2, as well as FIGS. 5 through 13 and 30 through 33, illustrate in greater detail the construction of the standard modular or facing blocks 40 and various other blocks. FIG. 2, as well as FIGS. 5 through 7, depict the basic modular block 40 which is associated with the invention. FIGS. 30 and 31 are also associated with the basic or standard modular block 40 in FIG. 2. The remaining figures relate to other block constructions.

Standard Modular Block

As depicted in FIGS. 2 and 5 through 7, the standard modular block 40 includes a generally planar front face 50. The front face 50, in its preferred embodiment, is typically asthetically textured as a result of the manufacturing process. Texturing is, however, not a limiting characteristic of the front face 50. The front face 50 may include a precast pattern. It may be convex or concave or some other desired cast shape. Because the block 40 is manufactured principally by casting techniques, the variety of shapes and configurations, surface textures and the like for the front face 50 is not generally a limiting feature of the invention.

The front face 50, however, does define the outline of the modular blocks comprising the wall as shown in FIG. 1. Thus, the front face 50 defines a generally rectangular front elevation configuration, and because the blocks 40 are manufactured by means of casting techniques, the dimensions of the perimeter of front face 50 are typically those associated with a standard concrete block construction. This again, however, is not a limiting feature of the invention.

Spaced from and generally parallel to the front face 50 is a back face 52. The back face 52 is connected to the front face 50 by means of side walls 54 and 56 which generally converge towards one another from the front wall 50. The convergence is generally uniform and equal on both sides of the block 40. Convergence may commence from front edges 51, 53, or may commence a distance from front face 50 toward back face 52. Convergence may be defined by a single flat side surface or multiple flat or curved side surfaces. The convergence angle is generally in the range of 7° to 15° in the preferred embodiment of the invention.

The thickness of the block 40 or in other words, the distance between the front face 50 and back face 52 may be varied in accord with engineering and structural considerations. Again, typical dimensions associated with concrete block constructions are often relied upon by casters and those involved in precast or dry cast operations. Thus, for example, if the dimensions of the front face 50 are 16 inches wide by 8 inches high, the width of the back face would be approximately 12 inches and the depth or distance between the faces would be approximately 8 inches.

In the embodiment shown, the side walls 54 and 56 are also rectangular as is the back face 52. Parallel top and bottom surfaces 58 and 60 have a trapezoidal configuration and intersect the faces 50, 52 and walls 54, 56. In the preferred embodiment, the surfaces 58, 60 are congruent and parallel to each other and are also at generally right angles with respect to the front face 50 and back face 52.

The block 40 includes a first vertical passage or throughbore 62 and a second vertical passage or throughbore 64. Throughbores 62, 64 are generally parallel to one another. As depicted in FIG. 5 the cross-sectional configurations of the throughbores 62 and 64 are uniform along their length. The throughbores 62, 64 each include a centerline axis 66 and 68, respectively. The cross-sectional shape of-each of the throughbores 62 and 64 is substantially identical and comprises an elongated or elliptical slot or shape.

Each of the throughbores 62 and 64 and, more particularly, the axis 66 and 68 thereof, is relatively precisely positioned relative to the side edges 51 and 53 of the front face 50. The side edges 51 and 53 are defined by the intersection respectively of the side wall 54 and front face 50 and side wall 56 and front face 50. The axis 66 is one-quarter of the distance between the side edge 53 and the side edge 51. The axis 68 is one-quarter of the distance between the side edge 51 and the side edge 53. Thus the axes 66 and 68 are arrayed or spaced one from the other by a distance equal to the sum of the distances that the axes 66, 68 are spaced from the side edges 51 and 53.

The throughbores 62 and 64 are positioned intermediate the front face 50 and back face 52 approximately one-quarter of the distance from the front face 50 to the back face 52, although this distance may be varied depending upon engineering and other structural considerations associated with the block 40. As explained below, compressive forces on the block 40 result when an anchoring rod 46, which fits within each one of the throughbores 62 and 64, engages against a surface of each throughbore 62 or 64 most nearly adjacent the back face 52. The force is generally a compressive force on the material comprising the block 40.

Thus, it is necessary from a structural analysis viewpoint to ensure that the throughbores 62 and 64 are appropriately positioned to accommodate the compressive forces on block 40 in a manner which will maintain the integrity of the block 40.

A counterbore 70 is provided with the throughbore 62. Similarly, a counterbore 72 is provided with the throughbore 64. Referring first to the counterbore 70, the counterbore 70 is defined in the surface 58 and extends from back face 52 over and around the throughbore 62. Importantly, the counterbore 70 defines a pathway between the throughbore 62 and the back face 52 wherein a tensile member may be placed in a manner so that the tensile member may remain generally perpendicular to an element such as rod 46 positioned in the throughbore 62.

In a similar fashion, the counterbore 72 extends from the back face 52 in the surface 58 and around the throughbore 64. In the preferred embodiment, the counterbores 70 and 72 are provided in the bottom face 60 uniformly for all of the blocks 40. However, it is possible to provide the counterbores in the top face 58 or in both faces 58 and 60. Note that since the blocks 40 may be inverted, the faces 58 and 60 may be inverted between a top and bottom position. In sum, the counterbores 70 and 72 are aligned with and constitute counterbores for the throughbores 62 and 64, respectively.

In the preferred embodiment, a rectangular cross-section passage 74 extends parallel to the throughbores 62 and 64 through the block 40 from the top surface 58 to the bottom surface 60. The passage 74 is provided to eliminate weight and bulk of the block 40 without reducing the structural integrity of the block. It also provides a transverse counterbore connecting counterbores 70 and 72. The passage 74 is not necessarily required in the block 40. The particular configuration and orientation, shape and extent of the passage 74 may be varied considerably in order to eliminate bulk and material from the block 40.

The general cross-section of the throughbores 62 and 64 may be varied. Importantly, it is appropriate and preferred that the cross-sectional shape of the throughbores 62 and 64 permit lateral movement of the block 40 relative to anchoring rods 46, for example, which are inserted in the throughbores 62 and 64. Thus, the dimension of the throughbores 62 and 64 in the direction parallel to the back face 52 in the embodiment shown is chosen so as to be greater than the diameter of a rod 46. The transverse dimension of the throughbores 62 and 64 more closely approximates the diameter of the rod 46 so that the blocks 40 will not be movable into and out of a position. That is, the front face 50 of each of the blocks 40 in separate courses and on top of each other can be maintained in alignment. However, the blocks 40 can be preferably adjusted from side to side as one builds a wall of the type depicted in FIG. 1, though the blocks 40 are not adjustable inwardly or outwardly to any great extent. This maintains the planar integrity of the assembly comprising the retaining wall so that the blocks 40 will be maintained in a desired and generally planar array. Side to side adjustment insures that any gaping between the blocks 40 is maintained at a minimum and also permits, as will be explained below, various adjustments such as required for formation of inside and outside curves.

The depth of the counterbores 70 and 72 is optional. It is preferred that the depth be at least adequate to permit the elements 42 and/or 44 to be maintained below or no higher than the level of surface 58, so that when an additional course of blocks 40 is laid upon a lower course of blocks 40 that the elements 42 and/or 44 are appropriately and properly recessed so as not to interfere with the upper course of blocks 40.

Referring briefly to FIGS. 30 and 31, there is illustrated a manner in which the standard or modular blocks of FIGS. 2 through 5 can be manufactured. Typically, such blocks may be cast in pairs using dry casting techniques with the front face of the blocks 40 cast in opposition to each other with a split line such as split line 75 as depicted in FIG. 30. Then after the blocks are cast, a wedge or shear may be utilized to split the separate blocks 40 one from the other revealing a textured face such as illustrated in FIG. 31. Appropriate drag and draft angle with respect to such a casting operation will be necessary as will be understood by those of ordinary skill in the art. Also note, the dry cast blocks 40 are not reinforced typically. However, the dry cast block may include reinforcing fibers. Lack of reinforcement and manufacture by dry casting techniques of a block 40 for use with metallic and/or generally rigid stabilizing elements is not known to be depicted or used in the prior art.

Corner and/or Split Face Blocks

Figure 8:
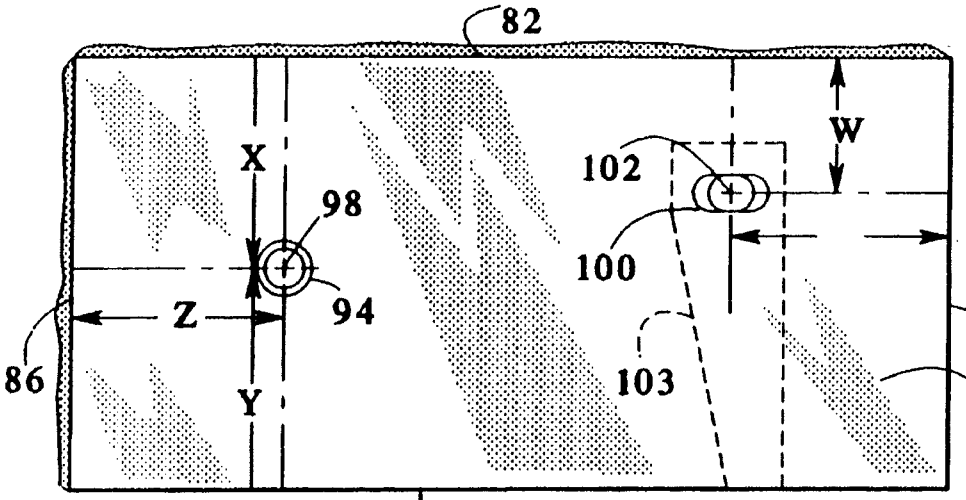
FIG. 8 is a top plan view of a corner block as contrasted from the wall block of FIG. 5.
Figure 10:
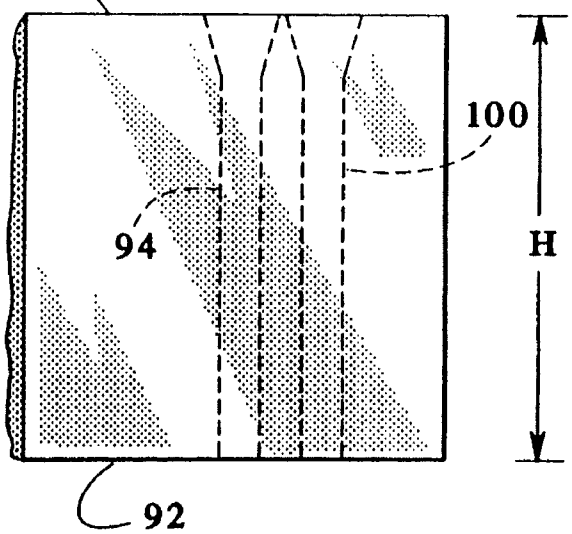
FIG. 10 is a side elevation of the block of FIG. 8.
Figure 9:
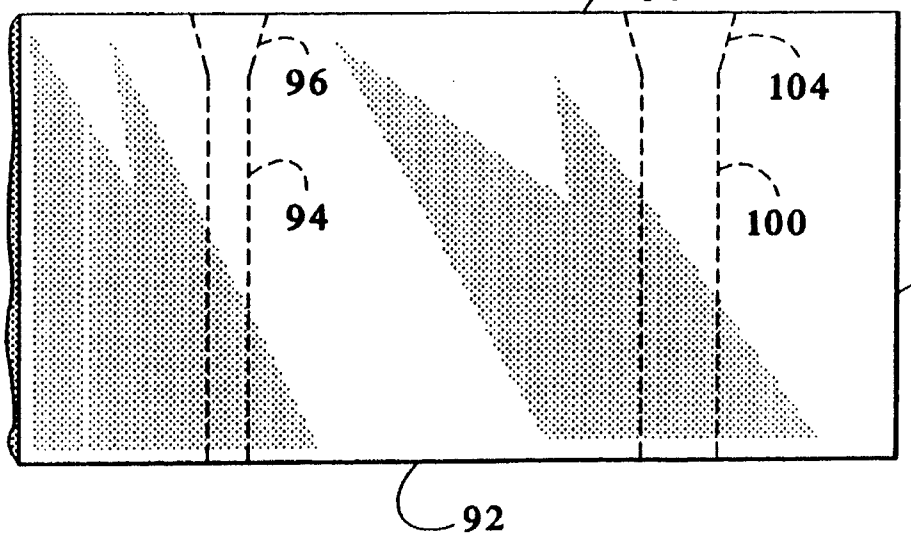
FIG. 9 is a rear elevation of the block of FIG. 8.

FIGS. 8 through 12, 32, 33 and 34 depict blocks that are used to form corners of the improved retaining wall construction of the invention or to define a boundary or split in such a retaining wall. FIGS. 8, 9 and 10 disclose a first corner block 80 which is similar to, but dimensionally different from the corner blocks 110 of FIGS. 11, 12 and 13. Referring, therefore, to FIGS. 8, 9 and 10, corner block 80 comprises a front face 82, a back face 84, a finished side surface 86 and a unfinished side surface 88. A top surface 90 is parallel to a bottom surface 92. The surfaces and faces generally define a rectangular parallelpiped. The front face 82 and the finished side surface 86 are generally planar and may be finished with a texture, color, composition and configuration which is compatible with or identical to the surface treatment of blocks 40. The corner block 80 includes a first throughbore 94 which extends from the top surface 90 through the bottom surface 92. The throughbore 94 is generally cylindrical in shape; however, the throughbore 94 may include a funnel shaped or frusto-conical section 96 which facilitates cooperation with a rod, such as rod 46, as will be explained below. The cross-sectional area of the throughbore 94 is slightly larger than the cross-sectional area and configuration of a compatible rod, such as rod 46, which is designed to fit through the throughbore 94. Importantly, the cross-sectional shape of the throughbore 94 and the associated rod, such as rod 46, are generally congruent to preclude any significant alteration and orientation of the corner block 80 once a rod 46 is inserted through a throughbore 94.

The position of the first throughbore 94 relative to the surfaces 82, 84 and 86 is an important factor in the design of the corner block 80. That is, the throughbore 94 includes a centerline axis 98. The axis 98 is substantially an equal distance from each of the surfaces 82, 84 and 86, thus rendering the distances x, y and z in FIG. 8 substantially equal, where x is the distance between the axis 98 and the surface 82, y is the distance between the axis 98 and the surface 84, and z is the distance between the axis 98 and the surface 86.

The corner block 80 further includes a second throughbore 100 which extends from the top surface 90 through the bottom surface 92. The second throughbore 100 may also include a funnel shaped or frusto-conical section 104. The cross-sectional shape of the throughbore 100 generally has an elongated or elliptical form and has a generally central axis 102 which is parallel to the surfaces 82, 84, 86 and 98.

The longitudinal dimension of the cross-sectional configuration of the second throughbore 100 is generally parallel to the front face 82. The axis 102 is specially positioned relative to the side surface 88 and the front face 82. Thus the axis 102 is positioned a distance w from the front face 82 which is substantially equal to the distance w which axis 66 is positioned from front face 50 of the block 40 as depicted in FIG. 5. The axis 102 is also positioned a distance v from the unfinished side surface 88 which is substantially equal to the distance v which the axis 62 is positioned from the edge 53 of the front face 50 of the block 40 as depicted again in FIG. 5. A counterbore 103 may be provided for throughbore 100. Counterbore 103 extends from back surface 84 and around bore 100. The counterbore 103 may be provided in both top and bottom surfaces 90 and 92.

The distance between the axis 102 and the axis 98 for the corner block 80 is depicted in FIG. 8 and is equal to the distance u between the axis 66 and the axis 68 for the block 40 in FIG. 5. The distance u is substantially to two times the distance v. The distance v between the axis 102 and the side surface 88 is substantially equal to the distance z between the axis 98 and the side surface 86. The correlation of the various ratios of the distances for the various blocks 40, 80 and 110 set forth above is summarized in the following Table No. 1:

TABLE 1

| | |
|---|---|
| For Block 40 | $2v = u$ |
| For Corner Block 80 | $x = y = z$ |
| | $x + y = u$ |
| | $v + z = u$ |
| For Corner Block 110 | $a = b = c$ |
| | $d = v + c$ |

Figure 13:
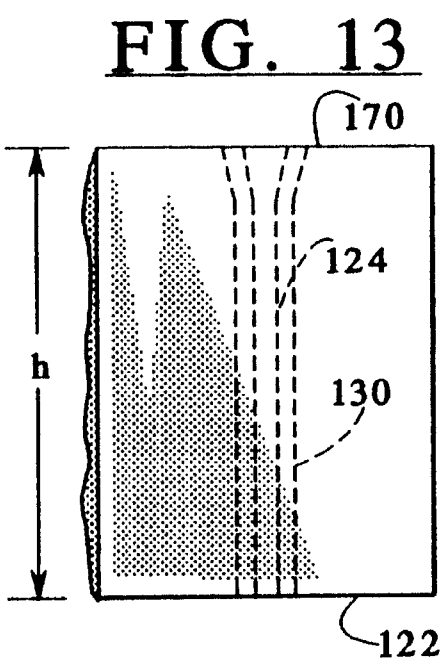
FIG. 13 is a side elevation of the block of FIG. 11.
Figure 11:
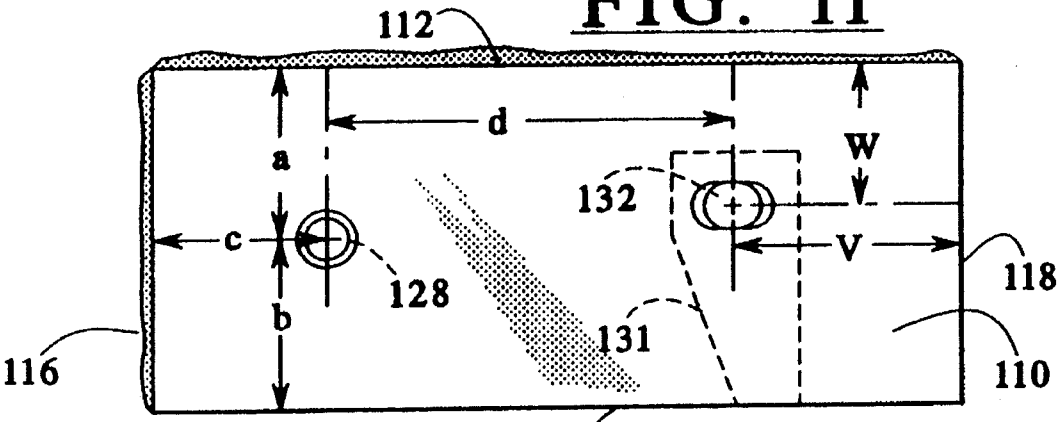
FIG. 11 is a top plan view of an alternative corner block construction.
Figure 12:
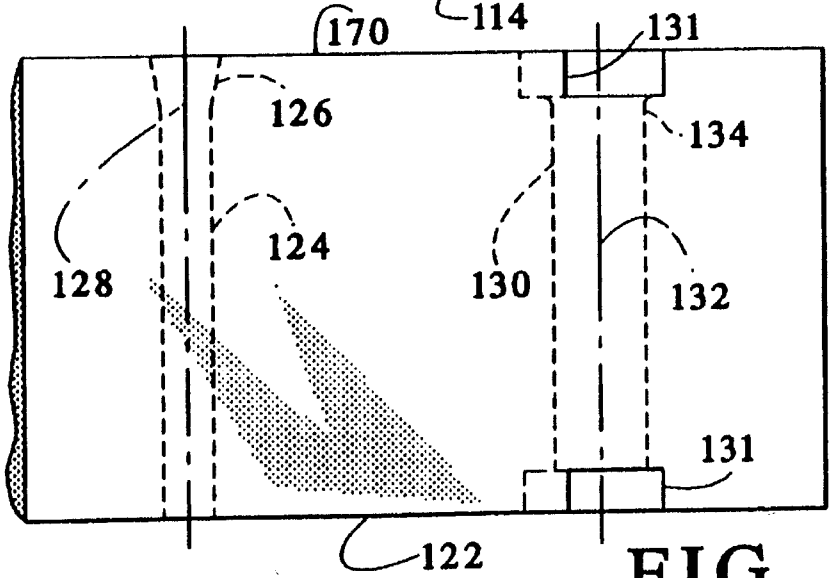
FIG. 12 is a rear elevation of the block of FIG. 11.

It is to be noted that the corner block 80 of FIGS. 8, 9 and 10 is a corner block 80 wherein the perimeter of the front face 82 is dimensionally substantially equal to the front face 50 of the block 40. FIGS. 11, 12 and 13 illustrate an alternative corner block construction wherein the front face and finished side face or surface are different dimensionally from that of the corner block 80 in FIGS. 8, 9 and 10.

Referring therefore to FIGS. 11, 12 and 13, a corner block 110 includes a front face 112, a back face 114, a finished side surface 116, an unfinished side surface 118, top and bottom parallel surfaces 120 and 122. The block 110 has a rectangular, parallelpiped configuration like the block 80. The block 110 includes a first throughbore 124 having a shape and configuration substantially identical to that of the first throughbore 94 previously described including the frontal section 126. Also included is an axis 128. Similarly, the block 110 includes a second throughbore 130 having an axis 132 with a cross-sectional configuration substantially identical to that of the second throughbore 100 and also including a frusto-conical or funnel shaped section 134. Also counterbores 131 may be provided in the top and bottom surfaces 120, 122. The front face 112 and finished side surface 116 are finished, as previously described with respect to front face 50, in any desired fashion. The front face 112 has a height dimension as illustrated in FIG. 13 as height which is substantially equal to the height of the block 40 in FIG. 7, as well as the height of the block 80 as illustrated in FIG. 10.

The axis 128 is again equally spaced from the face 112 surface 116 and surface 114 as illustrated in FIG. 11. Thus, the distance a from the surface 112 to axis 128 equals the distance b from the face 114 to the axis 128 which also equals the distance c from the surface 116 to the axis 128. The axis 132 is spaced from the front face 112 by the distance w which again is equal to the distance w of spacing of axis 66 from face 50 of block 40 as shown in FIG. 5. Similarly, the axis 132 is spaced a distance v from the unfinished side surface 118 which is equal to the distance v associated with the block 40 as depicted in FIG. 5. The distance between the axis 132 and the axis 128 represented by d in FIG. 11 equals the distance v between axis 132 and surface 118 plus distance c, the distance between axis 128 and finished side surface 116. Again, these dimensional relationships are set forth in Table 1.

Other alternative block constructions are possible within the scope of the invention and some modifications and alternatives are discussed below. However, the afore-described block 40 as well as the corner blocks 80 and 110 are principal modular blocks to practice the preferred embodiment of the invention.

Stabilizing Elements

Figure 14:
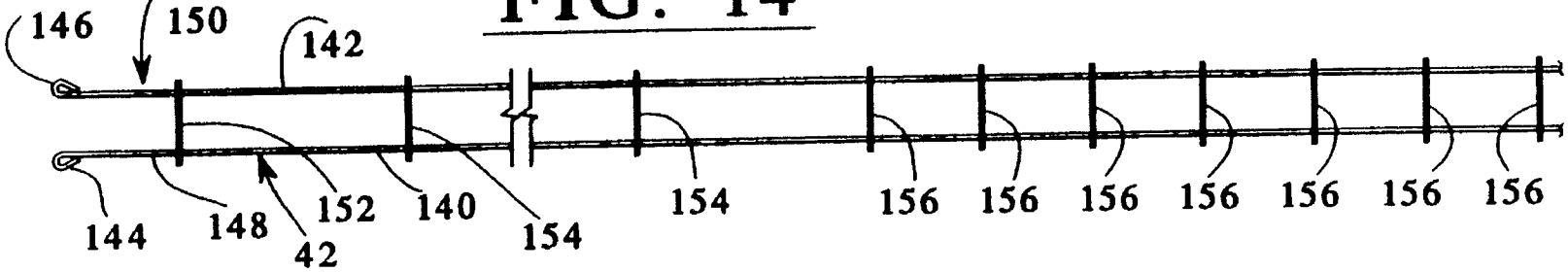
FIG. 14 is a top plan view of a typical earth stabilizing element or component of the type depicted in FIG. 3.

The second major component of the retaining wall construction comprises retaining elements which are interactive with and cooperate with the blocks 40, 80, and 110 particularly the basic block 40. FIGS. 14 through 17 illustrate various stabilizing elements. Referring first to FIG. 14, there is illustrated a stabilizing element 42 which is comprised of a first parallel reinforcing bar 140 and a second parallel reinforcing bar 142. The bars 140 and 142 each have a loop 144 and 146 respectively formed at an inner end thereof. Typically, the bars 140 and 142 are deformed to form the loops 144, 146 and the ends of the loops 144, 146 are welded back on to the bar 140 and 142.

Importantly, each loop 144 and 146 is connected to a tension arm 148 and 150 defined by the bars 140 and 142. The tension arms 148 and 150 are parallel to one another and are of such a length so as to extend beyond the back face of any of the blocks previously described. A cross member 152 positioned beyond the back face of the block 40 connects the arms 148 and 150 to ensure their appropriate spacing and alignment. A second cross member 154 ensures that the arms 148 and 150, as well as the bars 140 and 142 remain generally parallel.

There are additional cross members 156 provided along the length of the bars 140 and 142. The spacing of the cross members 156 is preferably generally uniform along the outer ends of the bars 140 and 142. The uniformly spaced cross members 156 are associated with the passive zone of a mechanically stabilized earth structure as will be described in further detail below. The cross members 156 are thus preferably uniformly spaced one from the other at generally closer intervals in the so called passive zone. The bars or cross members 154 as well as cross member 152 are not necessarily closely spaced or even required so long as the bars 140 and 142 are maintained in a substantially parallel array.

It is noted that in the preferred embodiment, that just two bars 140 and 142 are required or are provided. However, stabilizing elements having more than two longitudinal members (e.g. bars 140, 142) may be utilized. The stabilizing element depicted and described in FIG. 14 relies upon frictional interaction as well as anchoring interaction with compacted soil. The cross members 156 thus act as a collection of anchors. The bars 140 and 142 provide for frictional interaction with compacted soil.

Figure 15:
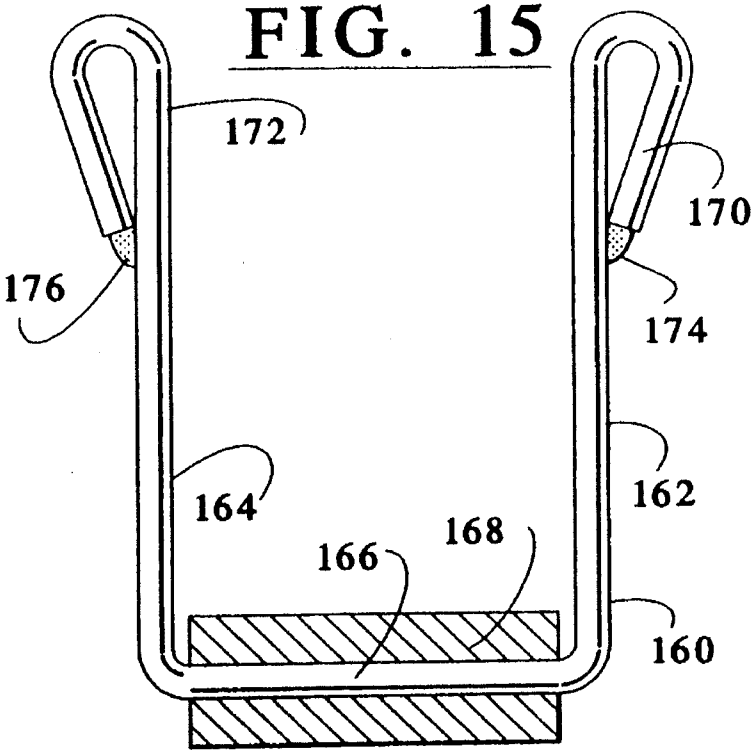
FIG. 15 is a top plan view of an alternative earth stabilizing element.
Figure 15A:
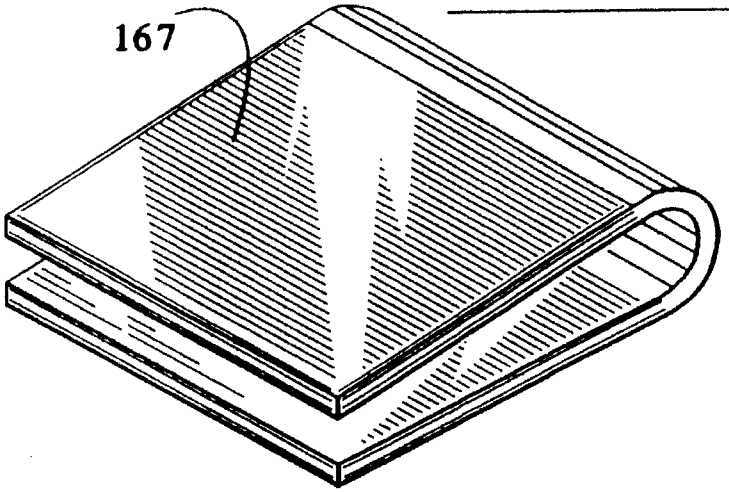
FIG. 15A is an isometric view of an alternative for the element of FIG. 15.

FIG. 15 illustrates a component of a further alternative stabilizing element 44. Specifically referring to FIG. 15, the element depicted includes a harness or connector 160 which includes a first tension bar or arm 162 and a second bar or arm 164. Arms 162 and 164 are generally parallel to one another and are connected by a cross member 166, which in this case also includes a cylindrical, tubular member 168 retained thereon. Alternatively, as depicted in FIG. 15A, a C shaped clamp member 167 may be fitted over the cross member 166.

Each of the parallel tension arms 162 and 164 terminate with a loop 170 and 172. The loops 170 and 172 are arranged in opposed relationship and aligned with one another as depicted in FIG. 15. The ends of the loops 170 and 172 are welded at weld 174 and 176, respectively to the arms 162 and 164, respectively.

Figure 17:
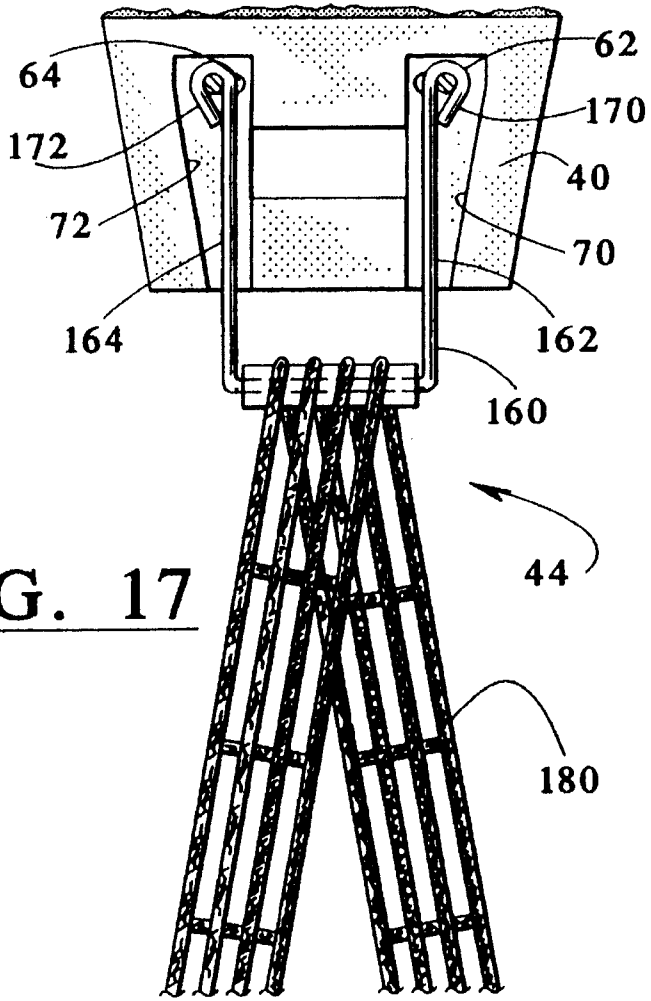
FIG. 17 is a top plan view of the component or element depicted in FIG. 16 in combination with a flexible geotextile material and a block of the type shown in FIG. 2.
Figure 16:
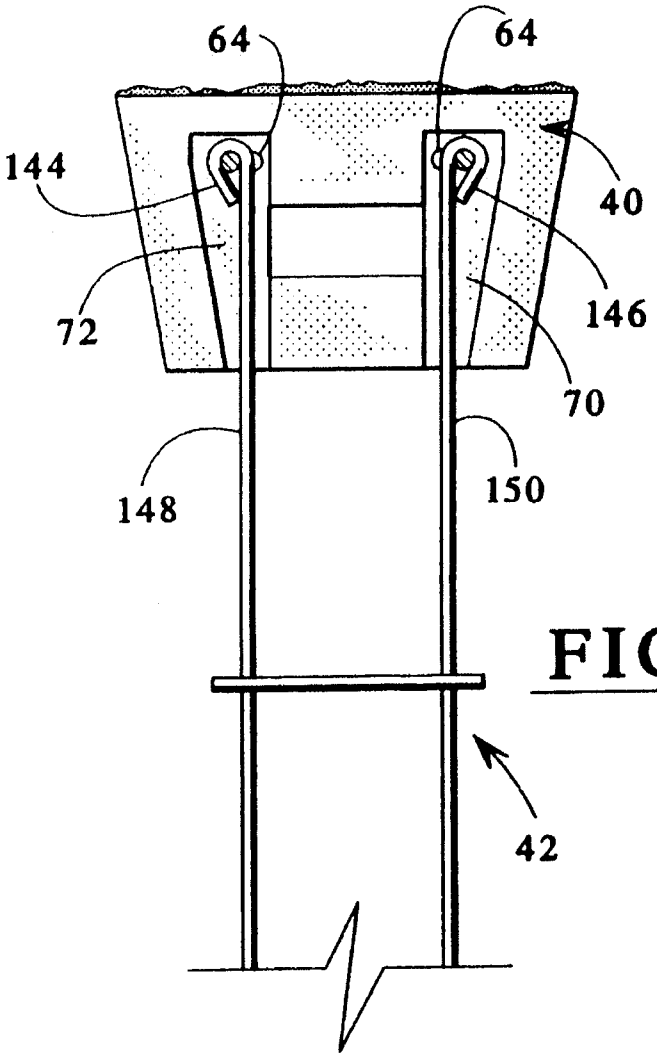
FIG. 16 is a top plan view of the element shown in FIG. 14 in combination with a block of the type shown in FIG. 2.

The harness or connector 160 is cooperative with the blocks, most particularly block 40, as will be described in further detail. That detail is illustrated, in part, in FIGS. 16 and 17. Referring first to FIG. 16, there is depicted a stabilizing element 42. FIG. 17 illustrates the stabilizing element 44. Referring to FIG. 16 the element 42 and more particularly the tension arms 148 and 150 are positioned in the counterbores 70 and 72 of block 40 with the loops 144 and 146 positioned over the throughbores 62 and 64, respectively.

Referring to FIG. 17, the connector 160, which comprises a portion of the stabilizing element 44, includes arms 162 and 164 which are fitted into the counterbores 70 and 72, respectively of block 40 with loops 170 and 172, respectively fitted over the throughbores 62 and 64. Note that connector 160 is sufficiently recessed within the block 40 so as to be below the plane of the top surface 58 thereof. Similarly, the tension arms 148 and 150 of the element 42 are sufficiently recessed within the counterbores 70 and 72 to be below the plane or no higher than the plane of the top surface 58 of the block 40.

Referring again to FIG. 17, the element 44 further includes a geotextile material comprising a lattice of a polymeric strips such as strip 180 which is generally flexible and wherein an elongated length thereof is wrapped around or fitted over the tube or cylinder 168 or clamp 167 so that the opposite ends of the strips 180 extend outwardly and away from the block 40. Thus, FIG. 16 illustrates a generally rigid element. FIG. 17 illustrates a generally flexible element. In each event, the elements 42 and 44 are cooperative with a block 40 as described.

Connectors

Figure 4A:
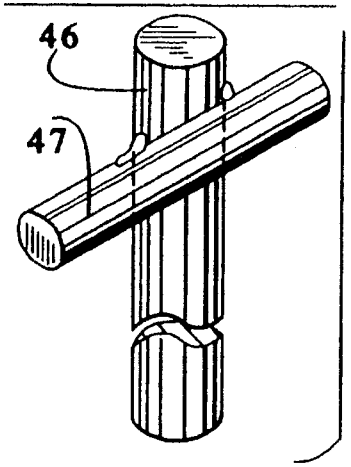
FIG. 4A is an alternate construction of the rod of FIG. 4.
Figure 4:
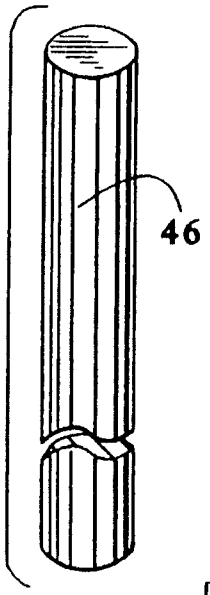
FIG. 4 is an isometric view of a typical anchoring rod which interacts with the wall block of FIG. 2 and the earth stabilizing element of FIG. 3 in the construction of the improved retaining wall of the invention.

Depicted in FIG. 4 is a typical connector which comprises a reinforcing rod or bar normally a steel reinforcing bar 46 which is generally cylindrical in shape and which is fitted through loops, for examples loops 170 and 172 in FIG. 17 and associated throughbores 62 and 64 of block 40 to thereby serve to retain the element 44 and more particularly the connector 160 cooperatively engaged with block 40. The rod 46 which is depicted as the preferred embodiment is cylindrical as previously mentioned. However, any desired size may be utilized. It is to be noted that the steel reinforcing bars which are recommended in order to practice the invention are also utilized in cooperation with the specially configured first throughbores 94, 124 of the corner blocks 80, 110. For example first throughbore 124 of the corner block 110 illustrated in FIG. 12 cooperates with a rod such as rod 46 illustrated in FIG. 4. The rods 46 are of a sufficient length so that they will project through at least two adjacent blocks 40 which are stacked one on top of the other thus distributing the compressive forces resulting from the elements 44 interacting with the blocks 40 to blocks adjacent courses forming a wall.

As depicted in FIG. 4A, the rod 46 may include a small stop or cross bar 47 welded or attached at its midpoint. Cross bar 47 insures that the rod 46 will be positioned properly and retained in position to engage blocks 40 above and below the block in which rod 46 is positioned to cooperate with elements 42, (4. Thus, the rod 46 will not fall or slip downward into throughbores 62, 64.

Retaining Wall System

Figure 18:
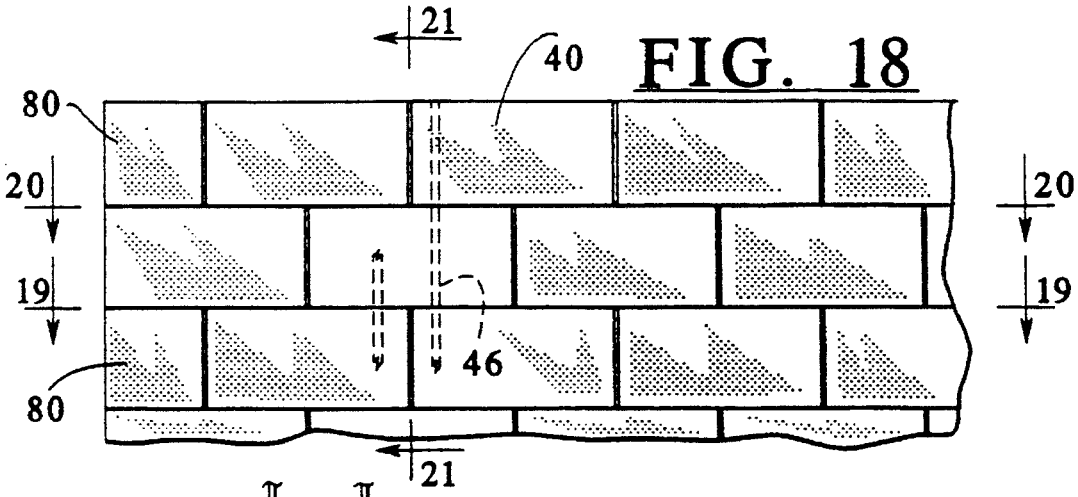
FIG. 18 is a front elevation of a typical assembly of the modular wall blocks of FIG. 2 and corner blocks such as shown in FIG. 8 in combination with the other components and elements forming a retaining wall.

FIGS. 18 through 29 illustrate the manner of assembly of the components heretofore described to provide a retaining wall. Referring first to FIG. 18, there is depicted an array of three courses of modular blocks 40 and corner blocks 80 to define a section or portion of a wall using the components of the invention. Note that each of the courses provide that the blocks 40 are overlapping. Note further that the front face dimensions of the corner block 80 are equal to the front face dimensions of the modular blocks 40. The side face or surface dimensions of the corner blocks 80 are equal to one half of the dimensions of the basic blocks 40.

Figure 19:
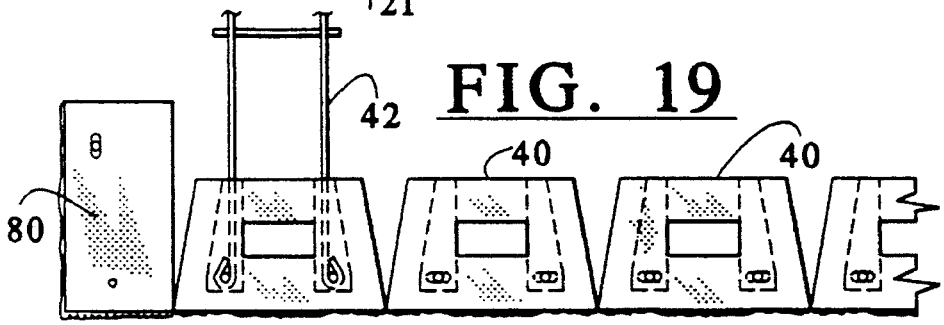
FIG. 19 is a sectional view of the wall of FIG. 18 taken substantially along the line 19—19.

FIG. 19, which is a sectional view of the wall of FIG. 18, illustrates the manner of positioning the corner blocks 80 and modular basic building blocks 40 with respect to each other to define the first course of the wall depicted in FIG. 18. Note that elements 42, which are the rigid stabilizing elements, are cooperatively positioned for interaction with the blocks 40. In the preferred embodiment, stabilizing elements 42 are provided for use in association with each and every one of the modular blocks 40 and the elements 42 include only two parallel reinforcing bars. It is possible to provide for construction which would have a multiple number of reinforcing bars or special anchoring elements attached to the bars. The preferred embodiment is to use just two bars in order to conserve with respect to cost and further, the two bar construction provides for efficient distribution of tensile forces and anchoring forces on the element 42 and torsional forces, are significantly reduced.

Figure 20:
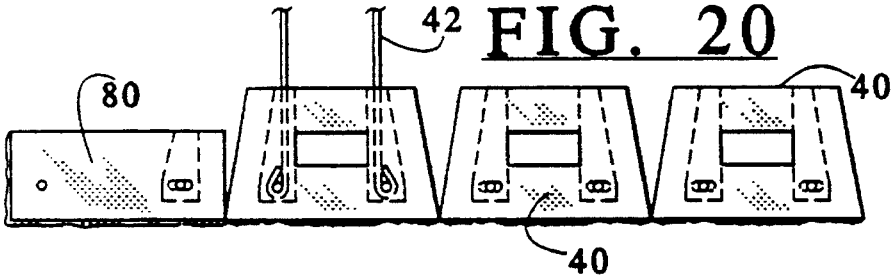
FIG. 20 is a sectional view of the wall of FIG. 18 taken along line 20—20 in FIG. 18.

FIG. 20 illustrates the manner in which the corner block 80 may be positioned in order to define an edge or corner of the wall depicted in FIG. 18. Thus, the block 80 which is a very symmetrical block as previously described, may be alternated between positions shown in FIGS. 19 and 20. Moreover, the corner blocks 80 may be further oriented as depicted and described with respect to FIGS. 27 through 29 below. The element 44 which is a stabilizing element utilizing a flexible polymeric or geotextile material is depicted as being used with respect to the course or layer of blocks defining or depicted in FIG. 20.

Figure 21:
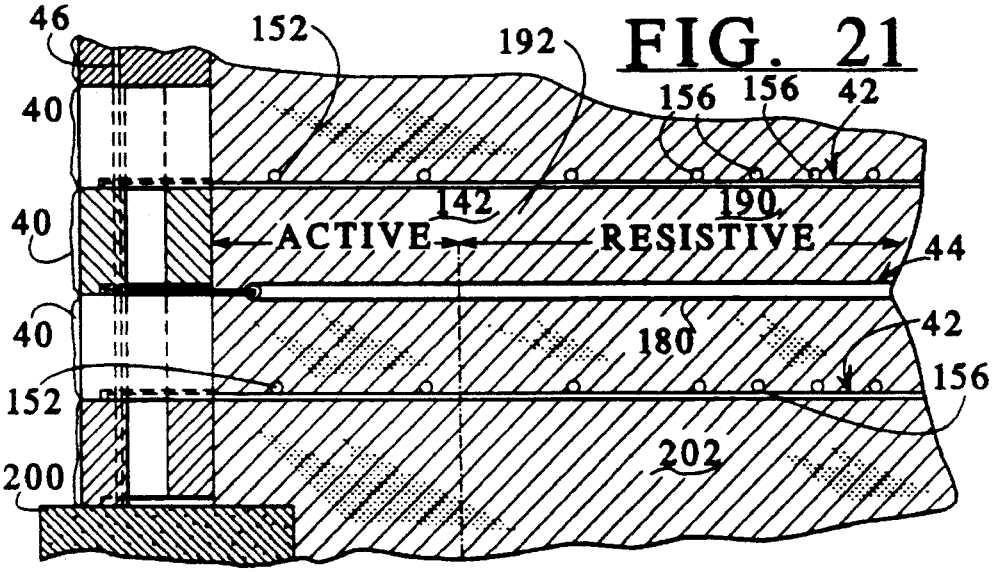
FIG. 21 is a cross sectional view of the wall of FIG. 18 taken substantially along the line 21—21.

FIG. 21 is a side sectional view of the wall construction of FIG. 18. It is to be noted that the wall is designed so that the cross elements 156 are retained in the so-called resistive zone associated with such mechanically stabilized earth structures. As known to those of ordinary skill in the art, construction of such walls and the analysis thereof calls for the defining of a resistive zone 190 and an active zone 192. The elements 42 are designed so that the, cross .members 156 are preferably more numerous in the resistive zone thus improving the efficiency of the anchoring features associated with the elements 42. FIG. 21 illustrates also the use of the polymeric grid material 180. It is to be noted that all of the elements 42 and/or 44 are retained in a compacted soil or compacted earth in a manner described in the previously referenced prior art patents. References is made to the American Association of State Highway and Transportation Officials "Standard Specification for Highway Bridges", Fourteenth Edition as amended (1990, 1991) and incorporated herewith by reference, for an explanation of design calculation procedures applicable for such constructions.

In FIG. 21 there is illustrated the placement of a stabilizing element, such as elements 42 or 44, in association with each and every course of blocks. In actual practice, however, the stabilizing elements 42 and/or 44 may be utilized in association with every course of every second, third or fourth course of blocks 40 or at every second or third block horizontally in accord with good design principles. This does not, however, preclude utilization of the stabilizing elements in association with each and every course and each and every block. It has been found, however, that the mechanically stabilized earth re-embankment does not require such numerous stabilizing elements. Again, calculations with respect to this can be provided using techniques known to those of ordinary skill in the art such as referenced herein.

During construction, a course of, blocks 40 are initially positioned in a line on a desired footing 200 which may consist of granular fill, earthen fill, coverita or other leveling material. Earthen backfill material is then placed behind the blocks 40. An element such as stabilizing element 42 may then be positioned in the special counterbores in a manner previously described and defined in the blocks 40. Rods 46 may then be inserted to maintain the elements 42 in position with respect to the blocks 40. The rods 46 should, as previously described, interact with at least two adjacent course of blocks 40. A layer of sealant, fabric or other material may be placed on the blocks. Subsequently, a further layer of blocks 40 is positioned onto the rods 46. Additional soil or backfill is placed behind the blocks 40 and the process continues as the wall is erected.

In practice, it has been found preferable to orient the counterbores 70, 72 facing downward rather than upward during construction. This orientation facilitates keeping the counterbores 70, 72 free of debris, etc. during construction.

Figure 23:
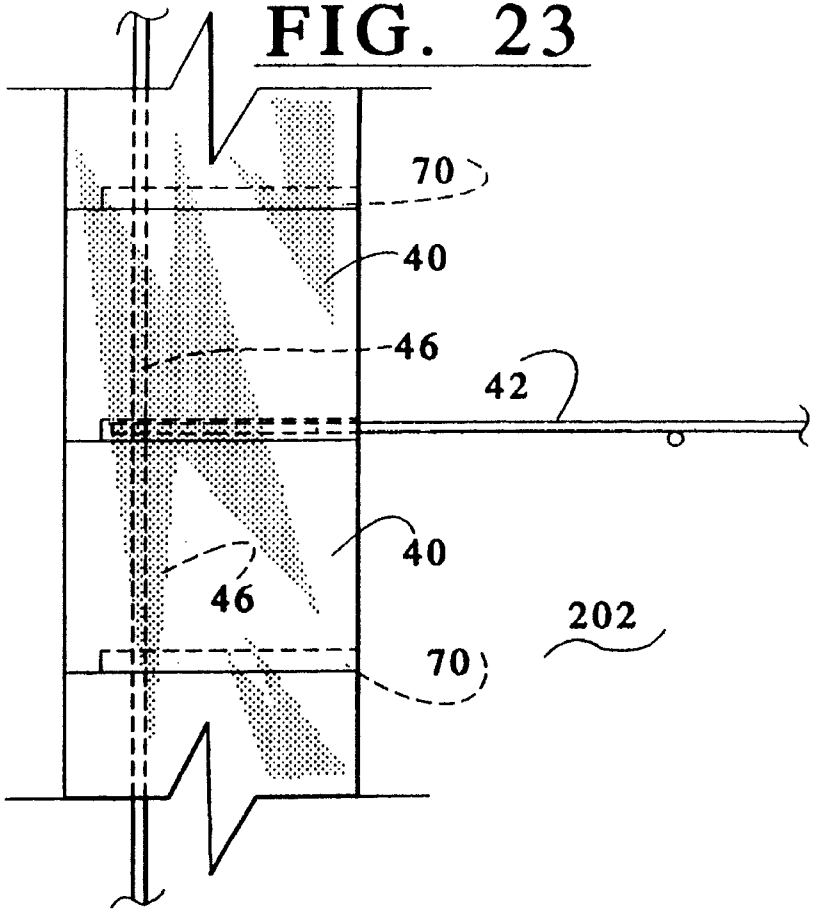
FIG. 23 is a side sectional view of a combination of elements of the type depicted in FIG. 16.
Figure 22:
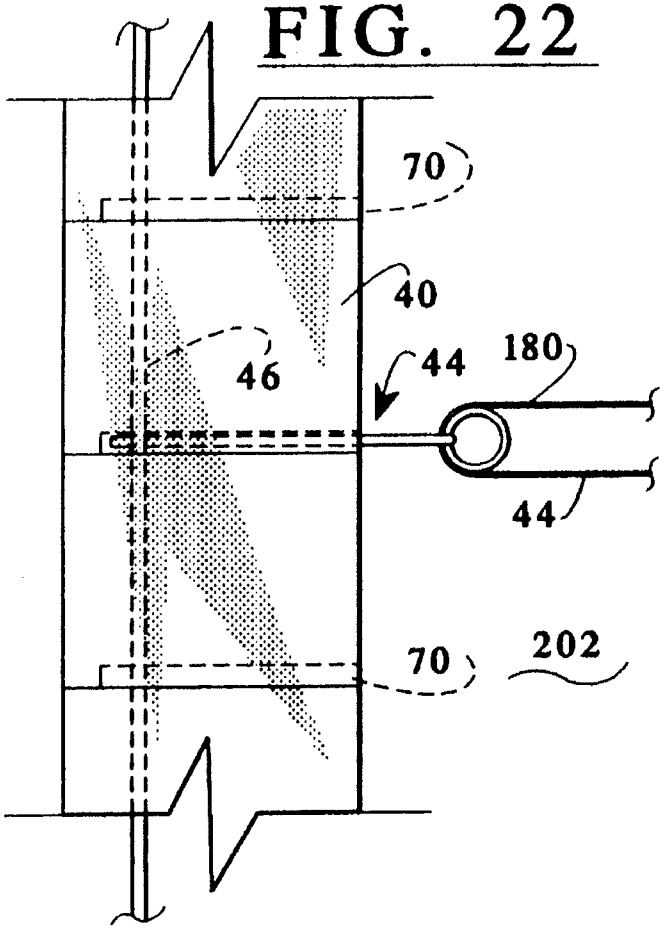
FIG. 22 is a side sectional view of a combination of the type depicted in FIG. 17.

FIGS. 22 and 23 illustrate side elevations of the construction utilizing a flexible stabilizing element 44 in FIG. 22 and a rigid stabilizing element 42 in FIG. 23. In each instance, the elements 42 and/or 44 are cooperative with blocks 40, rods 46 and compacted soil 202 as previously described.

Figure 24:
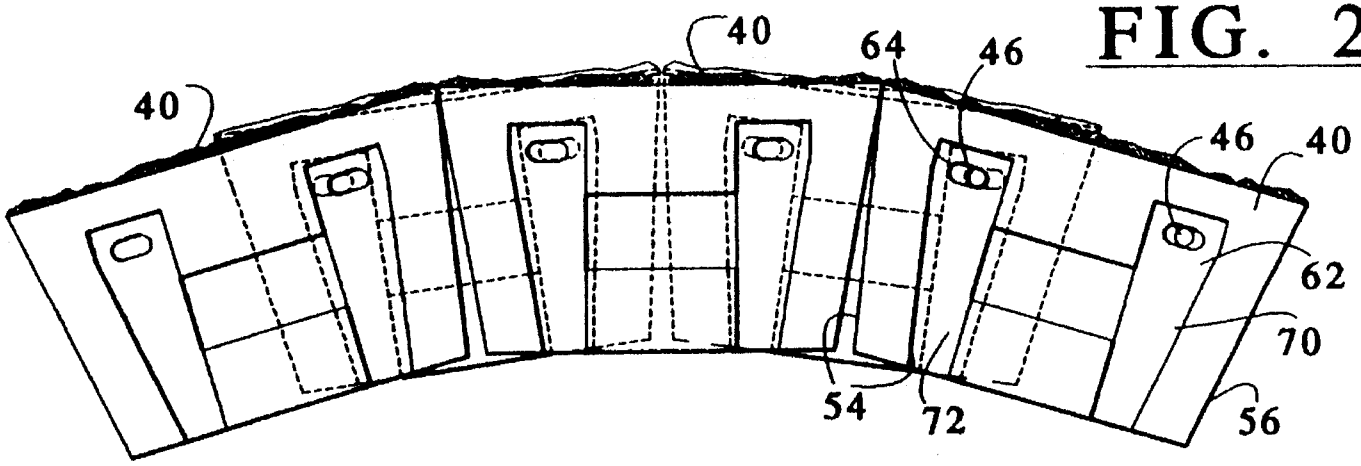
FIG. 24 is a top plan view of a typical retaining wall construction depicting the arrangement of the modular block elements to form an outside curve.
Figure 25:
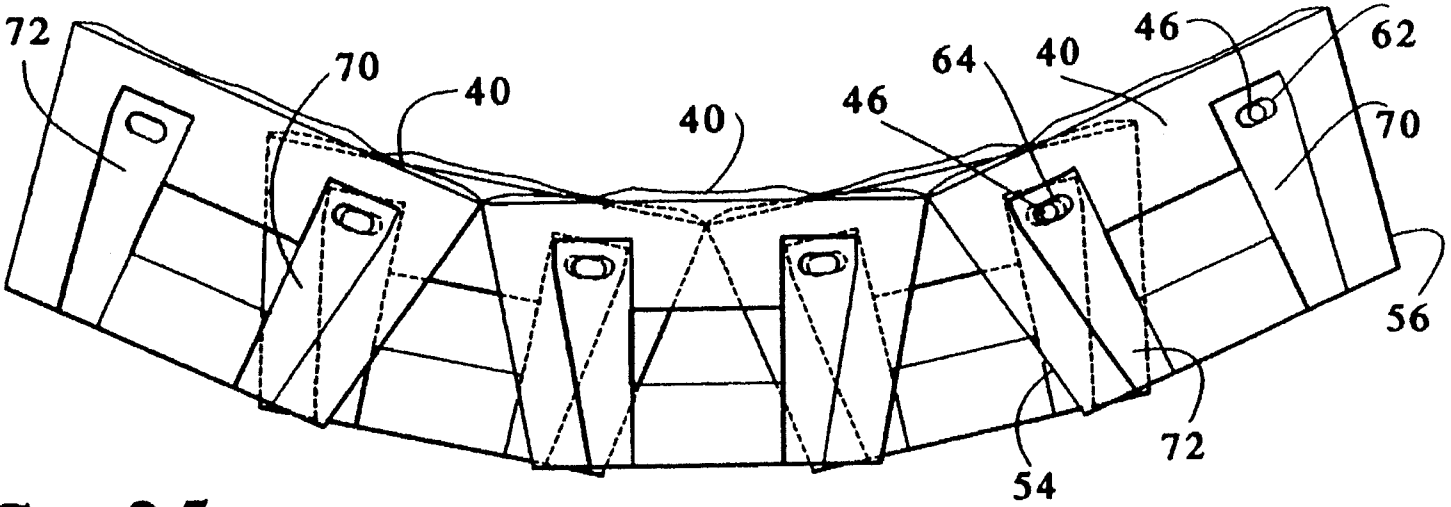
FIG. 25 is a top plan view of modular block elements arranged so as to form an inside curve.

Referring next to FIGS. 24 and 25, as previously noted the throughbores 62, 64 in the blocks 40 have an elongated cross-sectional configuration. Such elongation permits a slight adjustable movement of the blocks 40 laterally with respect to each other to ensure that any tolerances associated with the manufacture of the blocks 40 are accommodated.

It was further noted that the blocks 40 are defined to include converging side surfaces 54, 56. Because the side surfaces 54, 56 are converging, it is possible to form a wall having an outside curve as depicted in FIG. 24 or an inside curve as depicted in FIG. 25. In each instance, the mode of assembly and the cooperative interaction of the stabilizing elements 42, 44 and rods 46 as well as blocks 40 are substantially as previously described with respect to a wall having a flat front surface.

Figure 26:
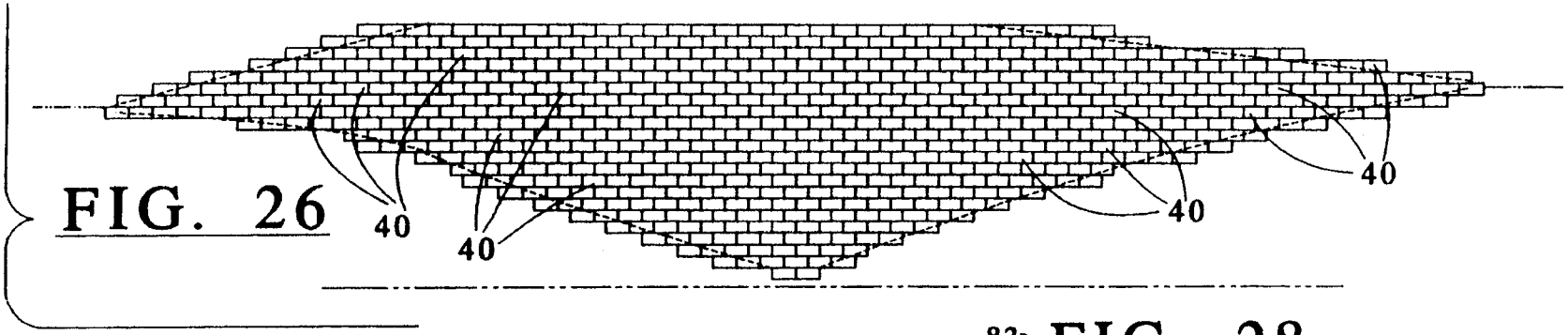
FIG. 26 is a front elevation depicting a typical retaining wall in accord with the invention.

FIG. 26 illustrates the versatility of the construction of the present invention. Walls of various shapes and dimensions and height may be constructed. It is to be noted that with the combination of the present invention the front face of the wall may be substantially planar and may rise substantially vertically from a footing. Though it is possible to set back the wall or tilt the wall as it descends, that requirement is not necessary with the retaining wall system of the present invention. Also, the footing may be tiered. Also, the block 40 may be dry cast and are useful with rigid stabilizing element such as elements 42, as contracted with geotextile materials.

Figure 28:
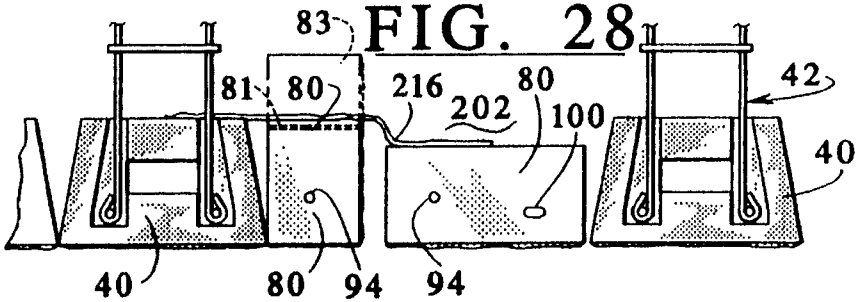
FIG. 28 is a sectional view of the wall shown in FIG. 27 taken substantially along the lines 28—28.
Figure 29:
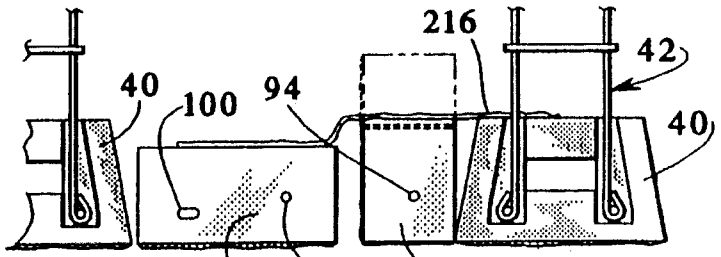
FIG. 29 is a section view of the wall of FIG. 27 taken substantially along the line 29—29.
Figure 27:
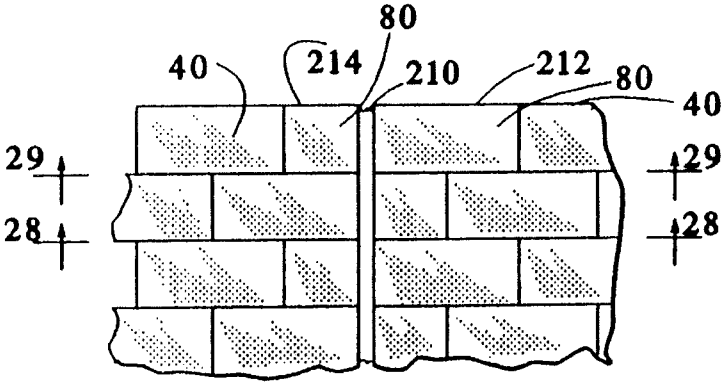
FIG. 27 is an enlarged front elevation of a retaining wall illustrating the manner in which a split-face may be constructed utilizing the invention.

FIGS. 27, 28 and 29 illustrate the utilization of corner blocks to provide for a split in a conventional wall of the type depicted in FIG. 26. As shown in FIG. 27, a split or vertical slot 210 is defined between wall sections 212 and 214. Sectional views of the walls 212 and 214 are depicted in FIGS. 28 and 29. There it will be seen that the corner blocks 80 which may be turned in either a right handed or left handed direction may be spaced from one another or positioned as closely adjacent as desired or required. A fabric or other flexible material 216 may be positioned along the back side of the blocks 80 and then backfill 202 positioned against the flexible material 216.

FIG. 29 illustrates the arrangement of these elements including the flexible barrier 216 and the blocks 80 for the next course of materials. It is to be noted that the first throughbore 94 of the corner blocks 80 as well as for the corner block 110 always align vertically over one another as each of the courses are laid. Thus a rod 46 may be passed directly through the first throughbores 94 to form a rigidly held corner which does not include the capacity for adjustment which is built into the throughbores 62, 64 associated with the blocks 40 or the second throughbore 100 associated with corner blocks 80. The positioning of the throughbores 94 facilitates the described assembly. The blocks 80 may include a molded split line 81 during manufacture. The line 81 facilitates fracture of the block 80 and removal of the inside half 83 or shown in FIG. 28.

FIGS. 32, 33, 34 and 34A illustrate the possible mode of casting corner blocks 80. Corner blocks 80 may be cast in an assembly comprising four corner blocks wherein the mold provides that the faces of the corner blocks 80 will be in opposition along a split line so that as depicted in FIG. 32, four corner blocks may be simultaneously cast, or as shown in FIG. 34, two corner blocks may be cast. Then as depicted in FIG. 33 and 34A, the corner blocks may be split from one another along the molded split lines to provide four (or two) corner blocks.

The stabilizing elements 42, 44, may also be cooperative with the counterbores 103, 131 of the corner blocks 80, 110. In practice such construction is suggested to stabilize corners of a wall. The elements 42, 44 would thus simultaneously cooperate with counterbores 103, 131 of a corner block 80, 110 and counterbores 70 or 72 of a modular block 40.

The described components and the mode of assembly of those components constitutes a preferred embodiment of the invention. It is to be noted that the corner blocks 80 as well as the standard modular blocks 40 may be combined in a retaining wall having various types of stabilizing elements and utilizing various types of analysis in calculating the bill of materials. That is, the stabilizing elements have both anchoring capabilities as well as frictional interactive capability with compacted soil or the like. Thus, there is a great variety of stabilizing elements beyond those specifically described which are useful in combination with the invention.

For example, the stabilizing elements may comprise a mat of reinforcing bars comprised of two or more parallel bars which are designed to extend into compacted soil. Rather than forming the loops on the ends of those bars to interact with vertical rods 46, it is possible to merely bend the ends of such rods at a right angle so that they will fit into the throughbores 62, 64 through the blocks 40 thereby holding mats or reinforcing bars in position. Additionally, the rods 46 may be directly welded to longitudinal tensile arms in the throughbores thus eliminating the necessity of forming a loop in the ends of the tension arms.

Though two tensions arms and thus two reinforcing bars are the preferred embodiment, a multiplicity of tension arms may be utilized. Additionally as pointed out in the description above, the relative size of the corner blocks may be varied and the dimensional alternatives in that regard were described. The shapes of the rods 46 may be varied. The attachment to the rods 46 may be varied.

Figure 36:
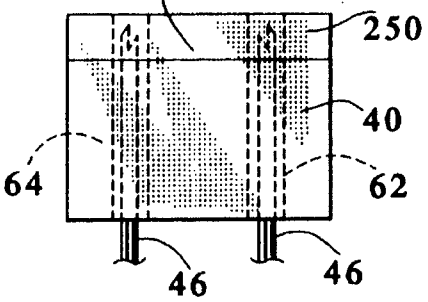
FIG. 36 is a front elevation of a wall construction with a cap block.
Figure 35:
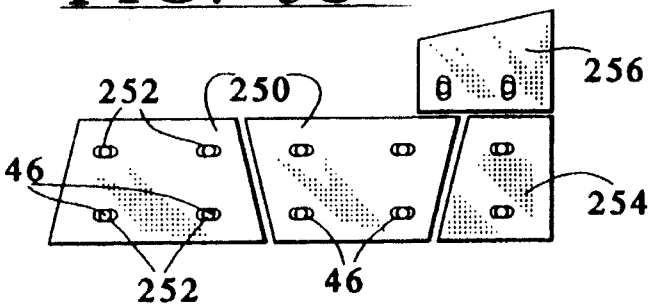
FIG. 35 is a top plan view of cap blocks.

Also, cap blocks 250 may be provided as illustrated in FIG. 35 and 36. Such blocks 250 could have a plan profile like that of modular blocks 40 but longer lateral dimension and would include four throughbores 252, which could be aligned in pairs with throughbores 62, 64. The cap blocks 250 may then be alternated in orientation as depicted in FIG. 35 with rods 46 fitting in proper pairs of openings 252. Mortar in openings 252 would lock the cap blocks 250 in place. Cap blocks 250 could also be split into halves 254, 256 as shown in FIG. 35 to form a corner. An alternative cap block construction comprises a rectangular shaped cap with a longitudinal slot on the .underside for receipt of the ends of rods 46 projecting from the top course of a row of blocks 40. Other constructions are also possible.

Figure 37:
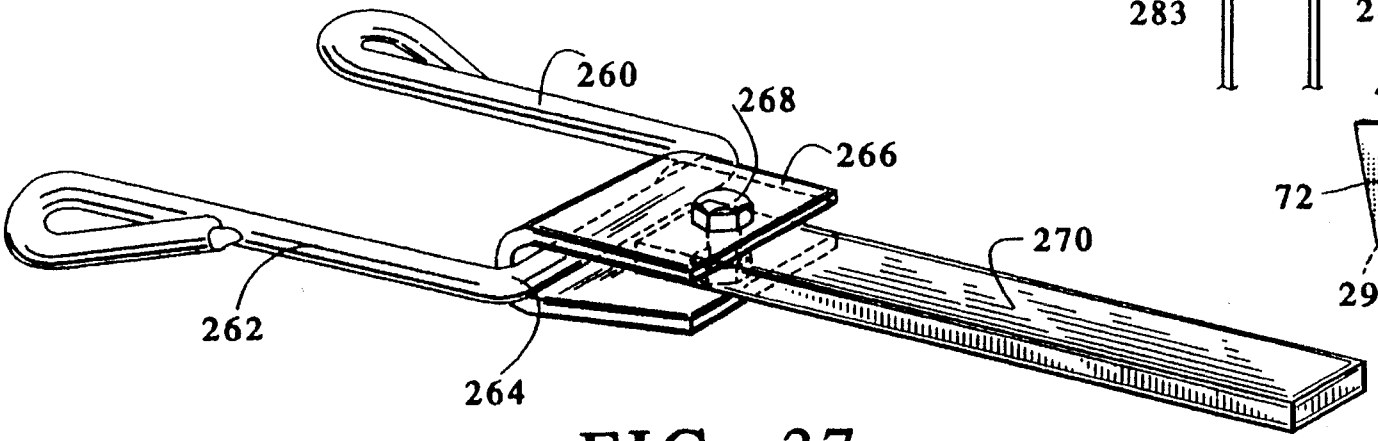
FIG. 37 is an isometric view of an alternative stabilizing element.

Another alternative construction for a stabilizing element is illustrated in FIG. 37. There tension arms 260, 262 and cross members 264 cooperate with a clamp 266 which receives a bolt 268 to retain a metal strip 270. Strip 270 is designed to act as a friction strip or connect to an anchor (not shown).

Figure 38:
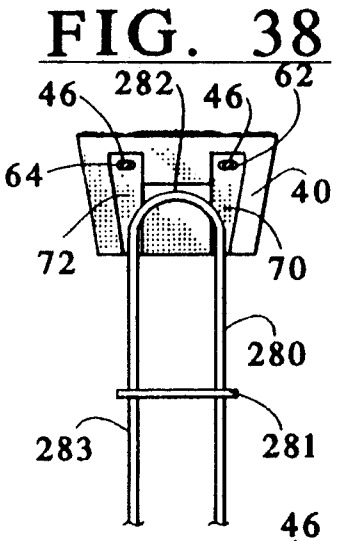
FIG. 38 is a top plan view of an alternative stabilizing element and wall block construction.

FIG. 38 depicts another alternative construction for a stabilizing element 280 and the connection thereof to block 40. Element 280 includes parallel tension arms 281, 283 with a cross member 282 which fits in the space between counterbores 70, 72 defined by passage 74. The shape of the walls defining the passage 74 may thus be molded to maximize the efficient interaction of the stabilizing element 280 and block 40.

Figure 39:
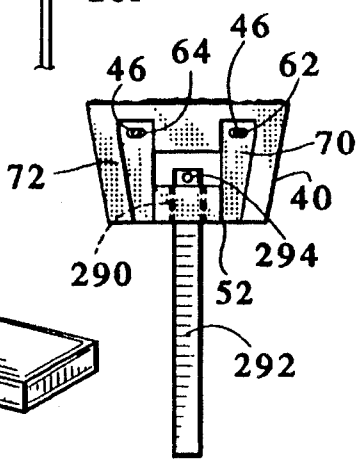
FIG. 39 is a plan view of another alternative stabilizing element and wall block construction.

FIG. 39 depicts yet another alternative construction wherein block 40 includes a passage 290 from internal passage 74 through the back face 52 of block 40. A stabilizing element such as a strip 292 fits through passage 290 and is retained by a pin 294 through an opening in strip 292. Strip 292 may be tied to an anchor or may be a friction strip. Rods 46 still are utilized to join blocks 40.

Figure 41:
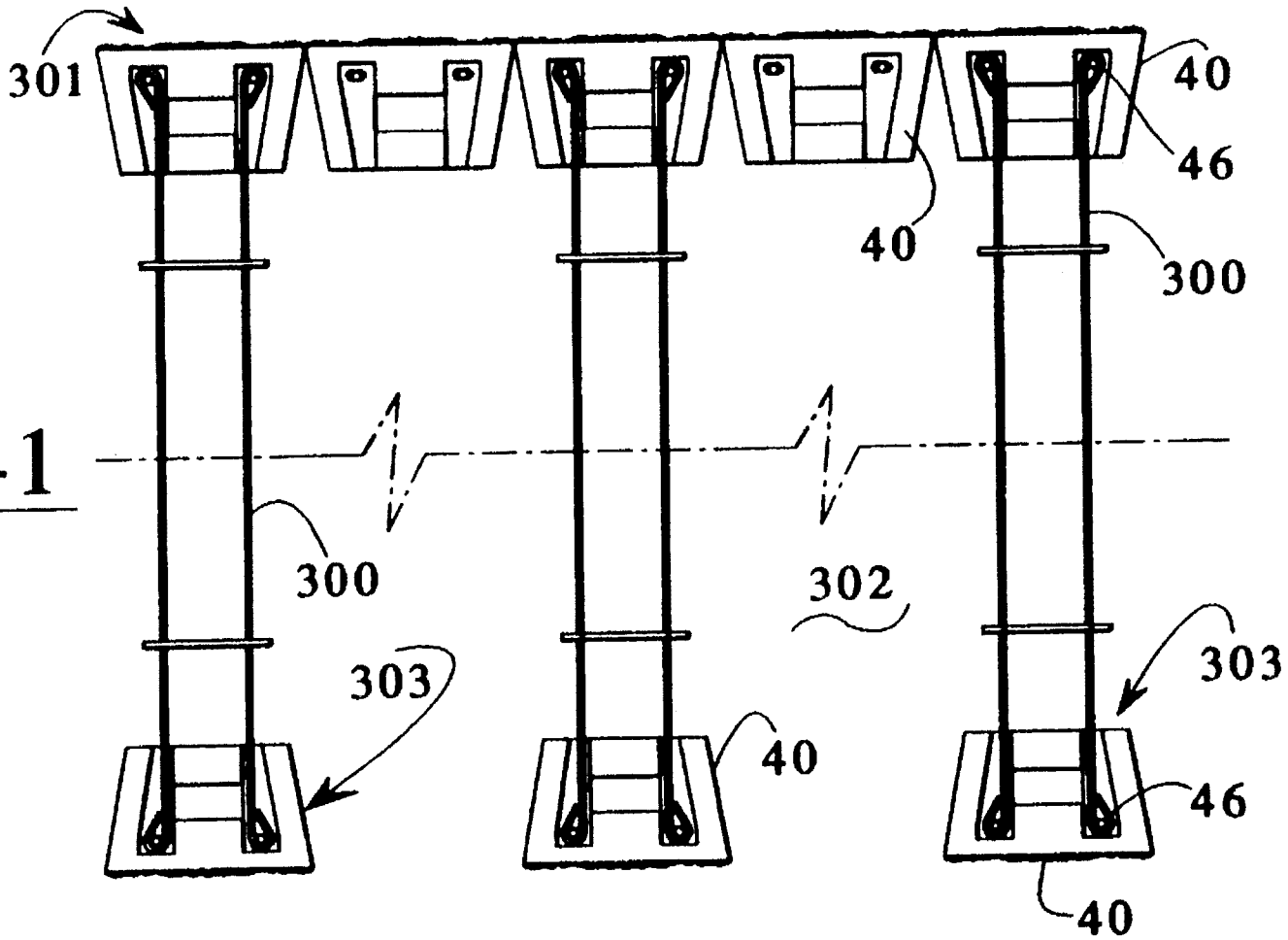
FIG. 41 is a top plan view of the wall construction of FIG. 40.

FIG. 40 and 41 depict a wall construction comprised of blocks 40 in combination with anchor type stabilizing elements. The anchor type stabilizing elements are in turn comprised of double ended tensile elements 300 analogous to elements 42 previously described. The elements 400 are fastened to blocks at each end by means of vertical rods 46. The blocks 40 form on outer wall 302 and an inner anchor 304 connected by elements 300. Anchors 304 are imbedded in compacted soil. The inside surface of the outer wall 302 may be lined with a fabric liner 306 to prevent soil erosion. This design for a wall construction utilizes the basic components previously described and may leave certain advantages especially for low wall constructions.

The invention, therefore, has many variations and is only to be limited by the following claims and equivalents.

What is claimed is:

1. An improved wall construction comprising, in combination:

a plurality of facing block members arrayed in overlapping courses one upon the other, each block member having a generally planar front face, a back face, first and second sides connecting the front face to the back face and generally parallel top and bottom surfaces;

each block member also including at least two, generally parallel throughbores extending from the top surface through the bottom surface, each throughbore including a counterbore in one of the parallel top and bottom surfaces, each of said counterbores extending from around each of the throughbores through the back face to define a channel in the top or bottom surface of the block;

stabilizing elements comprising a tension arm positioned in selected counterbores of selected block members, each tension arm terminating in a loop having an opening generally congruent and overlying with a throughbore for said counterbore to define a pathway, said tension arms being generally parallel, and at least some of said tension arms connected together adjacent the back face of the block members;

vertical rods extending through the pathway defined by each loop opening and the associated throughbores of vertically adjacent block members;

the stabilizing elements including soil engaging means extending therefrom, said stabilizing elements projecting away from the back face of each block member; and compacted soil for receipt of the soil engaging means of the stabilizing elements.

2. The wall construction of claim 1 wherein each of the block members is substantially identical and the block members of adjacent courses are offset laterally with respect to each other.

3. The wall construction of claim 1 wherein the cross sectional area of the vertical rods is less than the cross sectional area of the throughbores to thereby enable movement of the rods relative to the throughbore.

4. The wall construction of claim 1 wherein the rods include means for maintaining the rods in a stabilized vertical position in the throughbore of the block member.

5. The wall construction of claim 1 wherein the block members of vertically adjacent courses include front faces which are generally vertically aligned.

6. The wall construction of claim 1 wherein the stabilizing elements comprise an elongated generally rigid, friction member extending from the back face into compacted soil and further including cross members connecting the elongated members.

7. The wall construction of claim 1 wherein the throughbores are elongated slots generally parallel to the front face of the block member.

8. The wall construction of claim 1 wherein the throughbores each define a centerline axis which is approximately one quarter of the distance from a side edge of the front face of the block member.

9. The wall construction of claim 1 wherein the tension arms of a stabilizing element in a block member are joined by a cross member adjacent the back face and further including a band looped over the cross member which extends into compacted soil.

10. The wall construction of claim 6 wherein the cross members are positioned in compacted soil behind the back face of the block members, said soil defining an active zone and a resistive zone.

11. The wall construction of claim 10 wherein the cross members in the resistive zone are uniformly spaced.

12. A wall constructions of claim 1 wherein the soil engaging means are rigid metal tensile members.

13. The wall construction of claim 1 wherein the soil engaging means comprise two parallel rigid metal tensile bars projecting into a resistive zone and providing generally equal tensile forces on each bar.

14. The wall construction of claim 1 wherein the stabilizing elements comprise at least in part a flexible polymeric material.

15. The wall construction of claim 1 wherein the block includes fiber reinforcement material.

16. The wall construction of claim 1 wherein the stabilizing elements include a rigid metal strip.

17. The wall construction of claim 1 wherein the stabilizing elements include tensile members connected to an anchoring element.

18. The wall construction of claim 1 wherein the block is dry cast and is assembled in combination with a rigid, metallic stabilizing elements.

19. An improved block member for construction of mechanically stabilized earth structures comprising, in combination: a cast member having a front face defining parallel side edges, and a top edge and a bottom edge connecting the side edges, a back face, side walls extending from the from face and connected with the back face, a top surface and a bottom surface generally parallel to the top surface; and first and second parallel throughbores from the top surface through the bottom surface, said throughbores generally parallel to the side edges of the front face, each of said throughbores having a centerline axis, each of said throughbores defining an elongated profile in a plane transverse to the centerline axis, said elongated profile having a major dimension extending toward the side walls, and said block also including a counterbore for each throughbore in at least one of the top or bottom surface, each counterbore overlying a throughbore and dimensioned to receive or loop member with a center opening over the throughbore, each counterbore section also including a connected channel extending through the back face for receipt of an elongated tensile arm connected to a loop.

20. The block of claim 19 wherein the counterbores are in the bottom surface, and wherein the top and bottom surfaces are flat planar surfaces.

21. The block of claim 19 wherein the counterbores comprise parallel channels extending through the back face.

22. The block of claim 19 further including a hollow passage through the block from the top surface through the bottom surface said passage positioned between the counterbores.

23. The block of claim 19 wherein each counterbore includes an enlarged section surrounding the throughbore and an extension therefrom through the back face.

24. The block of claim 19 wherein the centerline axis of one throughbore is spaced from the centerline axis of the other throughbore by approximately one-half the distance between the spaced side edges of the block.

25. The block of claim 19 wherein the convergence of each side wall is in the range of 7° to 15°.

26. The block of claim 19 wherein the front face of the block is generally fiat.

27. The block of claim 19 wherein the side walls converge from a position spaced from the front face toward the back face.

28. The block of claim 19 in combination with a second substantially identical block, said blocks being cast as an integral unit with the front face of each block opposed and joined in the cast condition for subsequent separation into separate blocks.

29. The block of claim 19 in combination with stabilizing elements positioned in the counterbores, said stabilizing elements each comprising a tensile arm in selected ones of said counterbores, each tensile arm having a loop overlying the throughbore of said counterbore and extending in said counterbore from the back face of the block.

30. The block of claim 29 wherein the tension arms are elongated tensile members.

31. The block of claim 30 wherein the tension arms are connected by at least one cross member.

32. The wall construction of claim 1 including a corner block at a terminal edge of a course of the wall, said corner block including a front face, with parallel side edges, a finished side face at a generally right angle to the front face, a generally parallel top surface and bottom surface, a back face, and a pair of spaced throughbores parallel to the side edges, the throughbore most closely adjacent the front face and finished side face having a centerline axis equispaced from the front face, the finished side face and the back face.

33. The wall construction of claim 32 wherein the corner block further includes a counterbore in at least one of the top and bottom surface aligned with a throughbore.

34. The wall construction of claim 32 wherein the top surface and bottom surface of the corner block are flat planar surfaces.

35. An improved stabilizing element for use in combination with a block having counterbores in a surface of the block, said counterbores comprising first and second generally parallel channels in the surface of the block extending from one face of the block toward an opposite face and terminating within the block as a counterbore section, said stabilizing element comprising, in combination: first and second generally planar tensile members, each tensile member having an internal end formed as a generally horizontal loop, said loops being coplanar and each loop lying in generally the same plane, each loop shaped to provide an opening to at least partially surround a vertical throughbore and to receive a vertical rod, each loop sized to fit into a counterbore; and said stabilizing element further comprising at least one transverse cross member connecting the parallel tensile members and maintaining the loops spaced from one another by a fixed distance.

36. The stabilizing element of claim 35 wherein the tensile members are elongated to project into a compacted soil substrate, and wherein a plurality of cross members connect the tensile members, said tensile members and cross members interacting at least in part by friction with soil compacted thereover.

37. The stabilizing element of claim 35 including a flexible tensile member wrapped over the cross member, said flexible tensile member having opposite free ends.

38. An improved wall construction comprising, in combination:

a plurality of facing block members arrayed in overlapping courses one upon the other, each block member having a generally planar front face, sides, a back face, and generally parallel top and bottom surfaces, each block member also including at least two generally parallel throughbores from the top surface through the bottom surface, each throughbore including a counterbore extending along a surface from over the throughbore and through the back face to define a channel in the block member and a recess which surrounds the throughbore;

a stabilizing element mounted in selected counterbores, said stabilizing element including tension arms, each one of said tension arms generally congruent with and positioned in a channel of a counterbore, said tension arms generally parallel and extending from the back face of the block members;

generally vertical rods extending through the throughbores of adjacent overlying courses of block members engaging the stabilizing elements to retain the tension arms in the counterbores and simultaneously retaining vertically overlapping blocks connected together;

said stabilizing elements including soil engaging means extending and projecting away from the back face of block members; and compacted soil for receipt of the soil engaging means.

39. The construction of claim 38 wherein each tension arm is joined to a rod.

40. The construction of claim 38 wherein each tension arm is a separate component from each vertical rod.

41. An improved wall construction comprising, in combination:

a plurality of facing block members arrayed in overlapping courses one upon the other, each block member having a generally planar front face, side faces, a back face, and generally parallel top and bottom surfaces, each block member also including at least two generally parallel throughbores from the top surface through the bottom surface, each throughbore including a counterbore extending along one surface, said counterbore overlaying and surrounding the throughbore and including a channel extending through the back face, said counterbores connected by a cross counterbore in said one surface;

a stabilizing element mounted in selected counterbores, said element including a tension arm located within selected counterbores, said tension arms in said counterbores generally parallel and some pairs of tension arms connected together by a connection member extending through the cross counterbore;

generally vertical rods extending through the throughbores and associated counterbores of adjacent overlying courses of block members connecting with the vertically adjacent blocks to hold them together, said vertical rods also engaged with tension arms in the associated counterbores;

said stabilizing elements including soil engaging means extending and projecting away from the back face of block members; and compacted soil for receipt of the soil engaging means.

42. An improved wall construction comprising, in combination:

a plurality of facing block members arrayed in overlapping courses, one upon the other, each block member having a generally planar front face, a back face, opposite side faces connecting the front face and back face, and generally parallel top and bottom surfaces;

each block member also including two, generally parallel, vertical throughbores extending from the top surface through the bottom surface, each of said two throughbores including a counterbore in one of the parallel top and bottom surfaces, said counterbores extending from around the throughbore and in a generally straight channel through the back face;

a stabilizing element comprising a tension arm positioned in selected counterbores of selected block members, each tension arm terminating in a loop which surrounds, at least in part, the throughbore of the selected counterbore, said tension arms being generally parallel and extending from the block members beyond the back face thereof;

vertical rods extending through each loop and through the associated throughbores of vertically adjacent blocks;

said stabilizing elements further including soil engaging components projecting away from the back face; and compacted soil for receipt of the soil engaging components.

43. The block member of claim 19 wherein the centerline axis of one throughbore is spaced from the centerline axis of the other throughbore by a approximately one-half the distance between the spaced side edges of the block member and each centerline axis is approximately one quarter of the distance from a side edge of the block member.

44. The wall construction of claim 38 wherein the counterbores comprise channels generally perpendicular to the back face of the block member.

45. An improved wall construction comprising, in combination:

a plurality of facing block members arrayed in overlapping courses one upon the other, each block member having a generally planar front face, side faces, a back face, and generally parallel top and bottom surfaces, each block member also including at least two generally parallel throughbores from the top surface through the bottom surface, each throughbore including a counterbore extending along one surface overlaying and around the throughbore and extending through the back face, said counterbores connected by a cross counterbore in said one surface;

a stabilizing element mounted in selected counterbores, said stabilizing element including a tension arm generally congruent and located within the counterbore, said tension arms in said counterbores being generally parallel;

said stabilizing elements further including a loop member at least partially surrounding a throughbore;

generally vertical rods extending through the throughbores of adjacent overlying courses of block members and connecting with the vertically adjacent block members to hold them together and coacting with a loop member of the stabilizing element in the associated throughbore to retain said element in the block member;

said stabilizing elements including soil engaging means extending from and projecting away from the back face of each block member; and compacted soil for receipt of the soil engaging means.

46. A stabilizing element for use in combination with a facing member of a mechanically stabilized earthen work, said stabilizing element adapted for interaction with compacted particulate, said stabilizing element comprising:

a first tensile member including a horizontal loop at one end and a reinforcing bar extending from the loop;

a second tensile member also including a horizontal loop at one end and also including a reinforcing bar extending from the loop, said loops lying in the same horizontal plane, said bars being generally parallel and also lying in the same horizontal plane as the loops, said bars extending a sufficient distance for frictional interaction, at least in part, with particulate material, said bars and loops being separated from one another and maintained in such separation by at least one cross member connecting the bars, said cross member attached to the bars and spaced from the loops by a distance which maintains the cross member in particulate material when the element is combined with a facing member.

* * * * *